US008672618B2

(12) United States Patent
Guemmer

(10) Patent No.: US 8,672,618 B2
(45) Date of Patent: Mar. 18, 2014

(54) MULTI-VANE VARIABLE STATOR UNIT OF A FLUID FLOW MACHINE

(75) Inventor: Volker Guemmer, Mahlow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1137 days.

(21) Appl. No.: 12/609,633

(22) Filed: Oct. 30, 2009

(65) Prior Publication Data

US 2010/0124487 A1 May 20, 2010

(30) Foreign Application Priority Data

Nov. 19, 2008 (DE) ..... 10 2008 058 014

(51) Int. Cl.
*F01D 9/02* (2006.01)

(52) U.S. Cl.
USPC ..... 415/162; 415/209.2

(58) Field of Classification Search
USPC ..... 415/159, 160, 161, 162, 163, 209.2, 415/209.3
See application file for complete search history.

(56) References Cited

U.S. PATENT DOCUMENTS

| | | | | |
|---|---|---|---|---|
| 3,069,070 | A * | 12/1962 | Macaluso et al. | 415/148 |
| 3,169,747 | A * | 2/1965 | Seymour | 415/195 |
| 3,296,800 | A * | 1/1967 | Kennan et al. | 60/244 |
| 3,687,569 | A | 8/1972 | Klompas | |
| 4,231,703 | A | 11/1980 | Weiler | |
| 6,457,938 | B1 * | 10/2002 | Liu et al. | 415/160 |
| 6,540,478 | B2 * | 4/2003 | Fiala et al. | 415/194 |
| 6,709,232 | B1 * | 3/2004 | Vogiatzis | 415/163 |
| 7,264,441 | B2 * | 9/2007 | Loudet | 415/144 |
| 7,360,990 | B2 * | 4/2008 | Barbe et al. | 415/160 |
| 2007/0003408 | A1 | 1/2007 | Lim | |
| 2008/0131268 | A1 | 6/2008 | Guemmer | |
| 2011/0312246 | A1 * | 12/2011 | Mohamed et al. | 451/1 |

FOREIGN PATENT DOCUMENTS

| | | |
|---|---|---|
| DE | 2835349 | 4/1979 |
| DE | 102005019896 | 11/2006 |
| DE | 102006052003 | 5/2008 |
| EP | 1998026 | 12/2008 |

OTHER PUBLICATIONS

German Search Report dated Nov. 4, 2011 for counterpart German patent application.

* cited by examiner

*Primary Examiner* — Nathaniel Wiehe
*Assistant Examiner* — Ryan Ellis
(74) *Attorney, Agent, or Firm* — Timothy J. Klima; Shuttleworth & Ingersoll, PLC

(57) ABSTRACT

A fluid flow machine has a main flow path which is confined by a hub (3) and a casing (2) and in which at least one row of variable stator vanes (1) is arranged. The stator vanes (1) are rotatably borne around a rotary axis 4. On at least one of the hub (3) and the casing (2), at least one arrangement with at least two stator vanes (1) connected to a common rotary base (5) is provided, such that the at least two stator vanes (1) are rotatable around the rotary axis (4) when this multi-vane variable stator unit is varied.

29 Claims, 20 Drawing Sheets

Figure 6B:
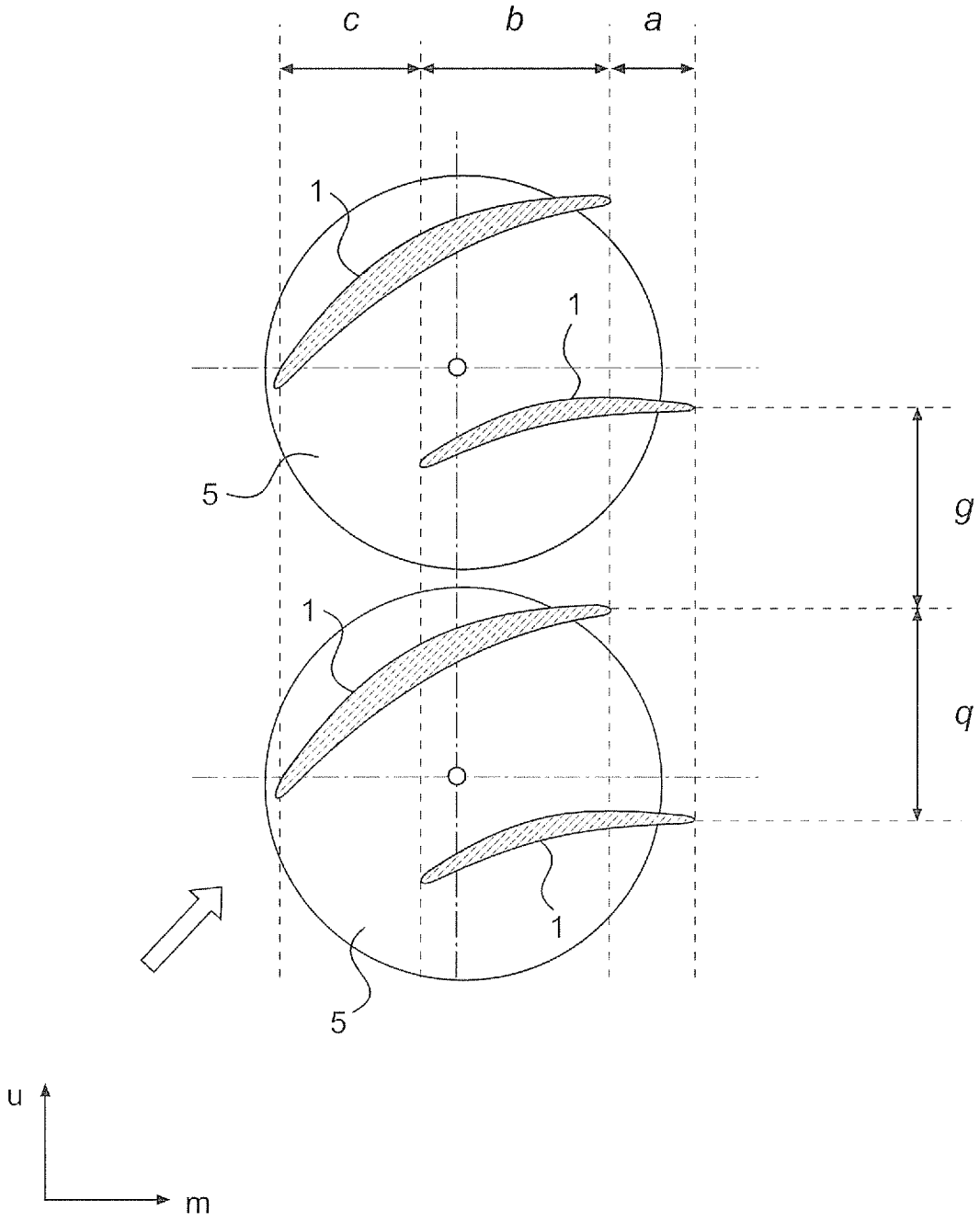

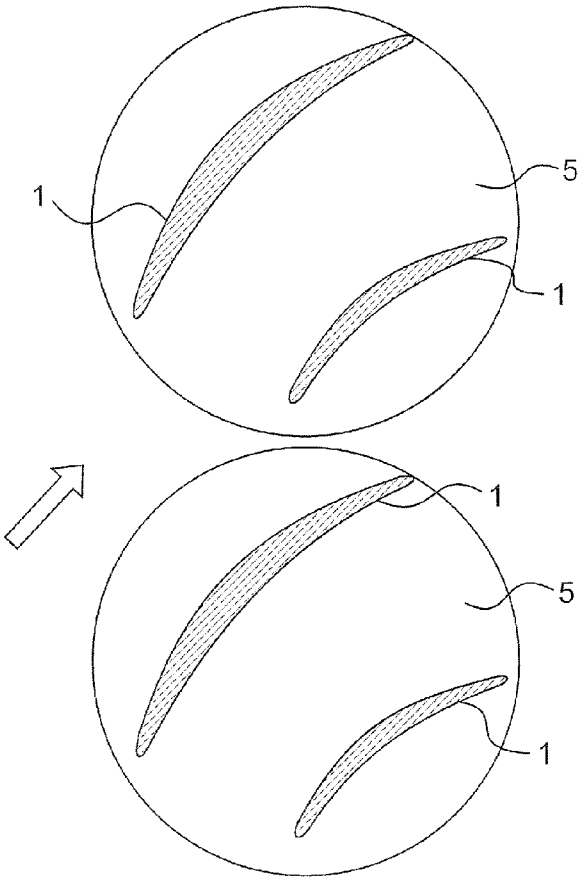
FIG. 6A-b
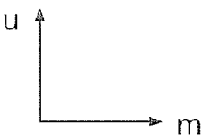
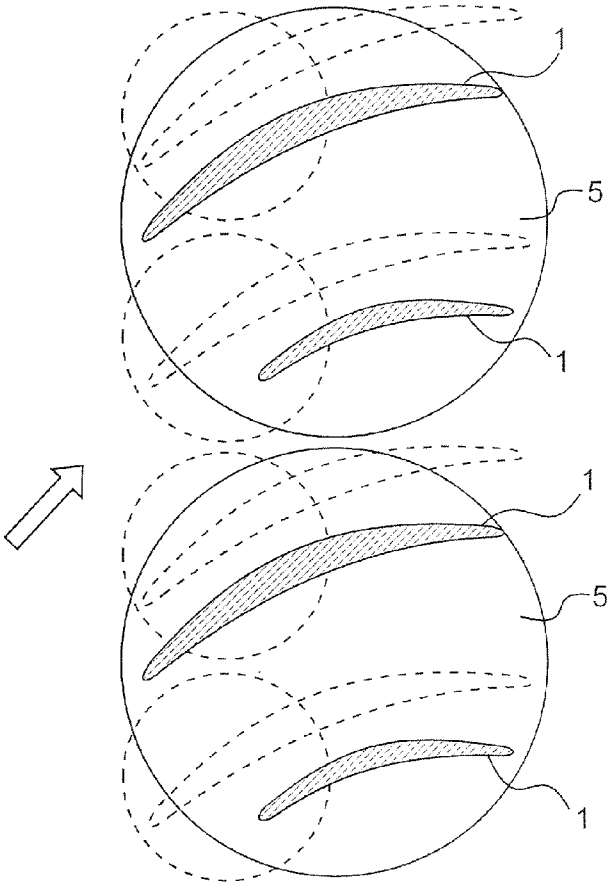
FIG. 6A-a

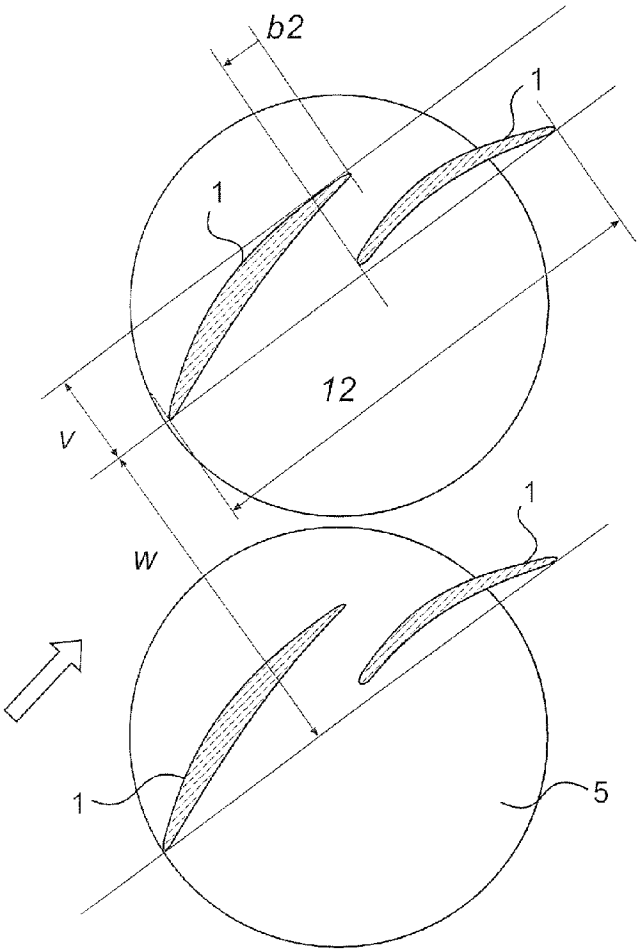
FIG. 6C-b
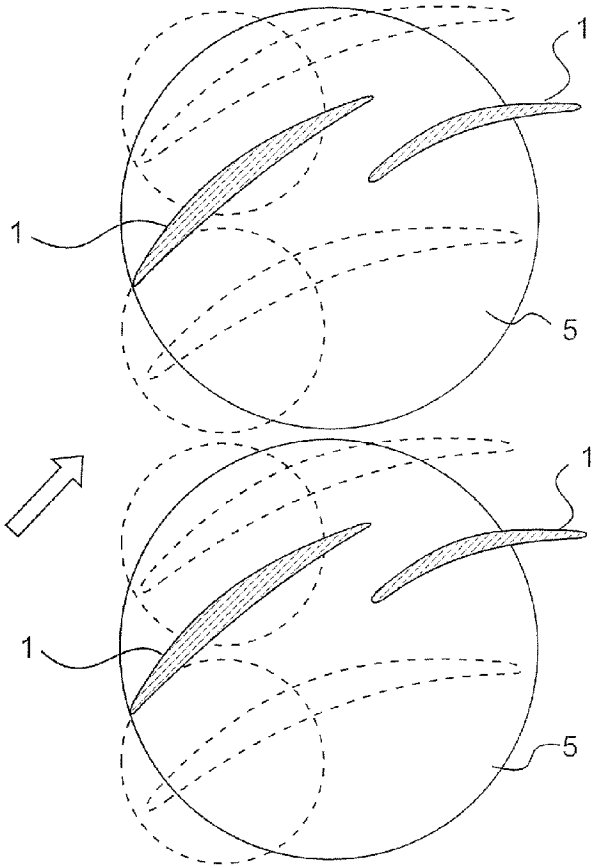
FIG. 6C-a

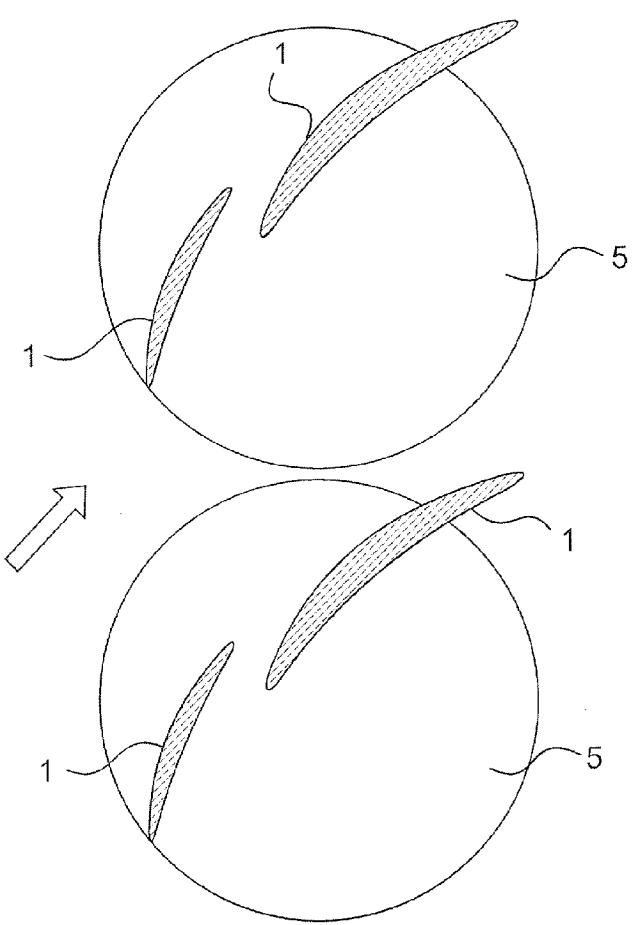
FIG. 6D-b
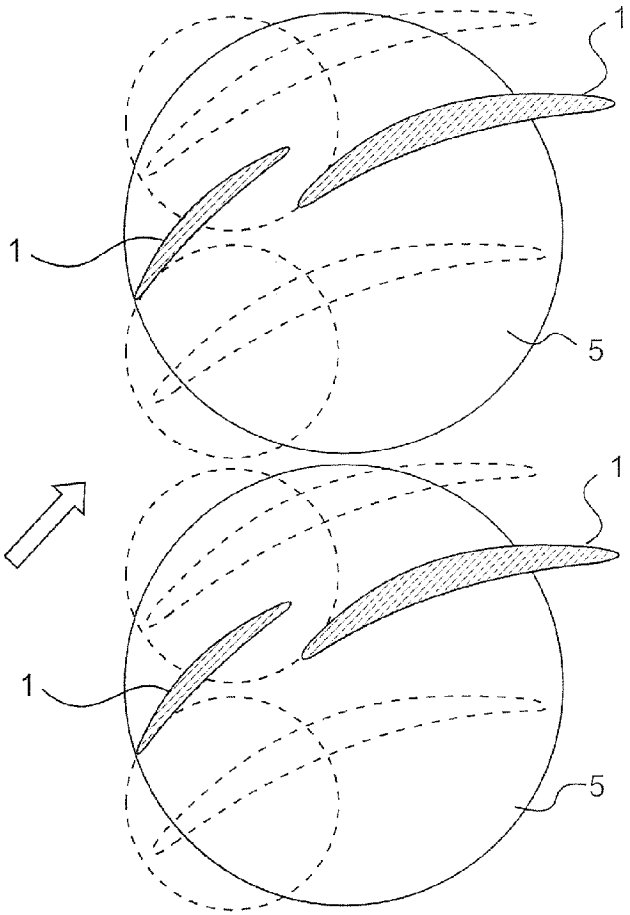
FIG. 6D-a

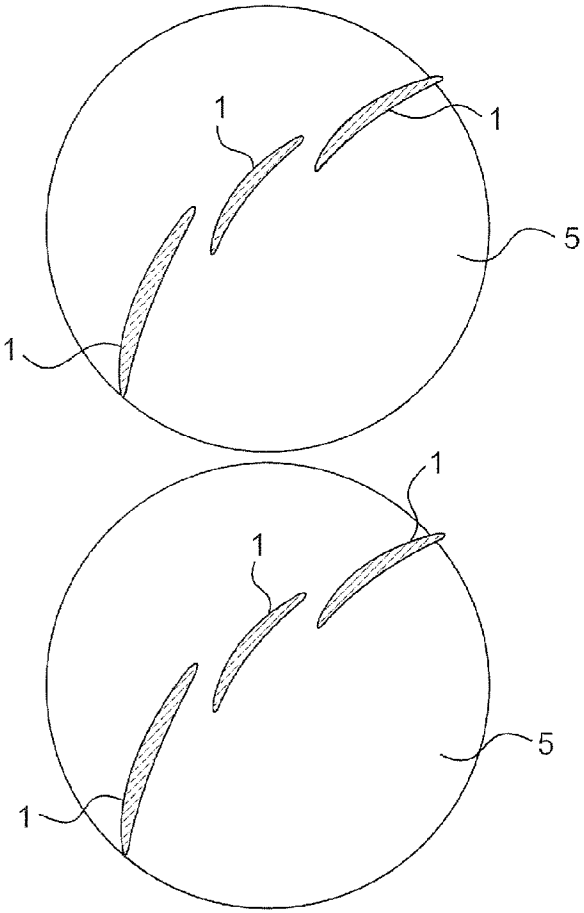
FIG. 6E-b
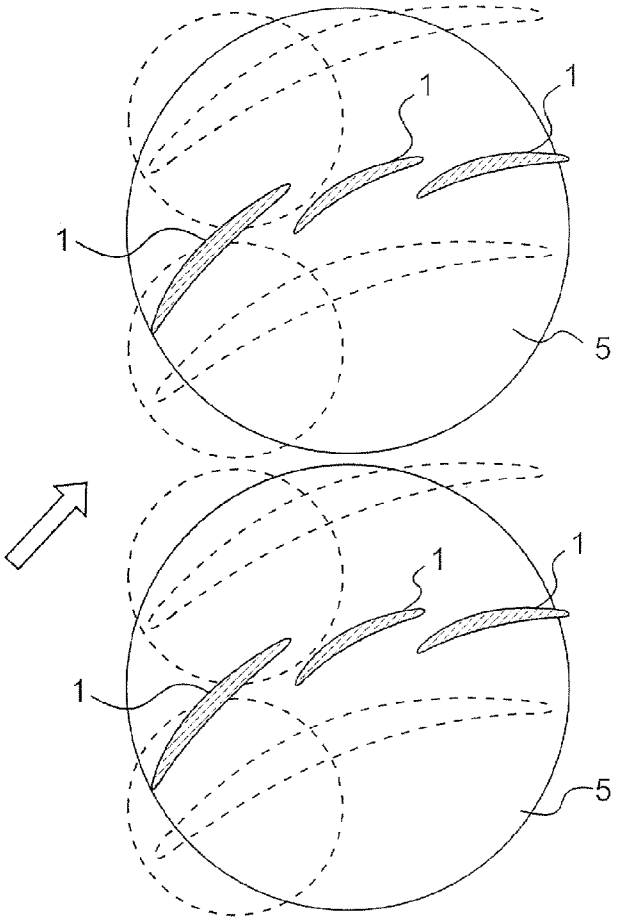
FIG. 6E-a

MULTI-VANE VARIABLE STATOR UNIT OF A FLUID FLOW MACHINE

This application claims priority to German Patent Application DE 10 2008 058 014.7 filed Nov. 19, 2008, the entirety of which is incorporated by reference herein.

This invention relates to a multi-vane variable stator unit of a fluid flow machine.

The aerodynamic loadability and the efficiency of fluid flow machines, for example blowers, compressors, pumps and fans, is limited in particular by the growth and the separation of boundary layers in the area of the radial gaps between the blading and the casing or the hub, respectively, these gaps being necessary at the annulus rim for reasons of design.

In particular on rotatable variable stators, the radial gaps, which may be generated by recesses before and behind the rotary spindle, are pronounced and entail considerable flow losses. In order to limit these losses, rotary bases of maximum possible size are provided on the inner and outer ends of the variable stators to keep small the extension of the recesses in flow direction.

Now the rotary bases are usually perfectly round. Since the diameter is restricted by the distance between two adjacent vanes, rotary bases must be provided, in particular in the case of close vane spacings as increasingly applied to modern machines, whose diameters are clearly smaller than the profile length of the vane in the respective hub or casing area. Thus, a considerable radial gap before and/or behind the rotary base is inevitable.

Figure 1:
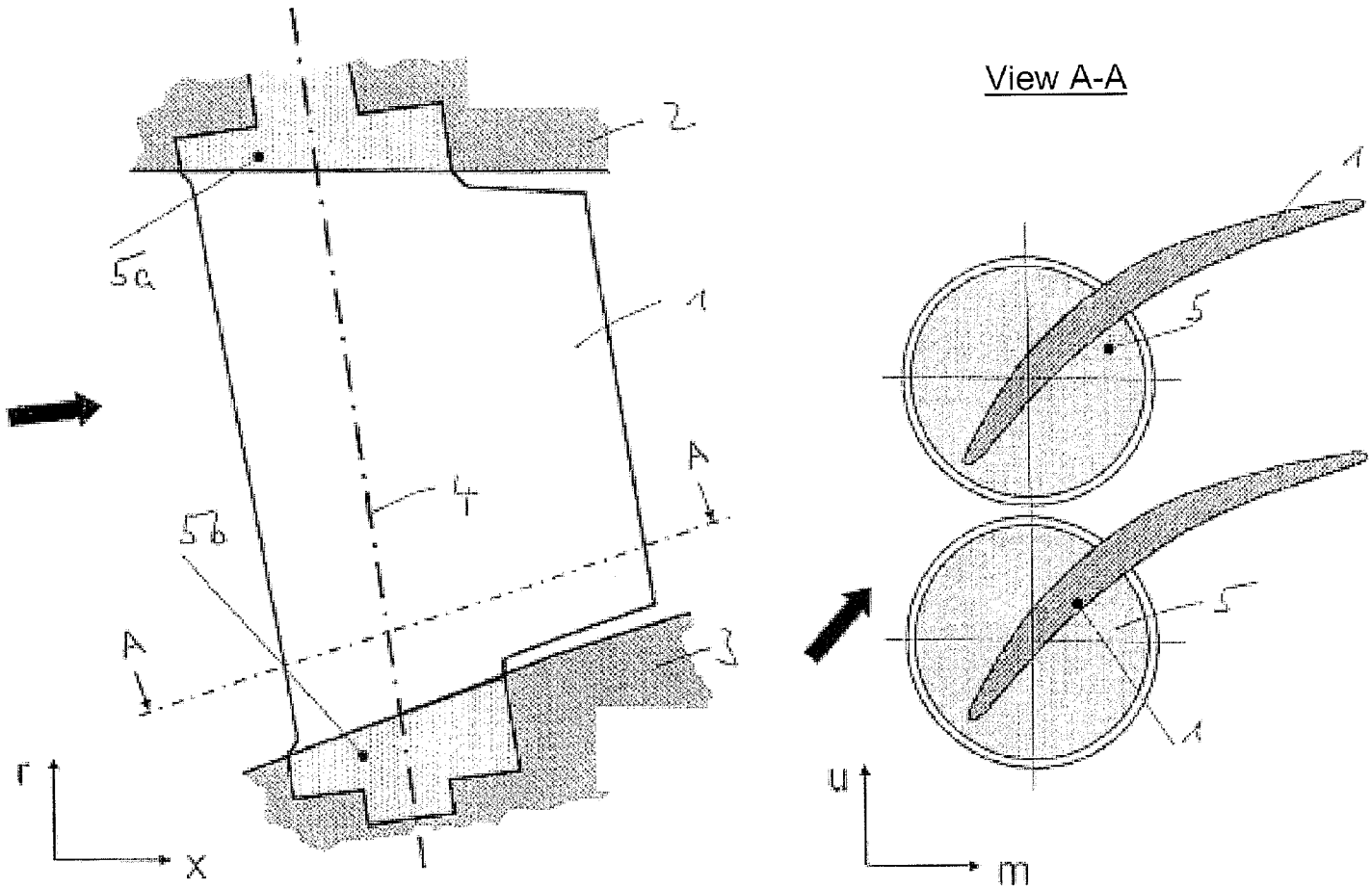
Fig. 1: PRIOR ART
Figure 10:
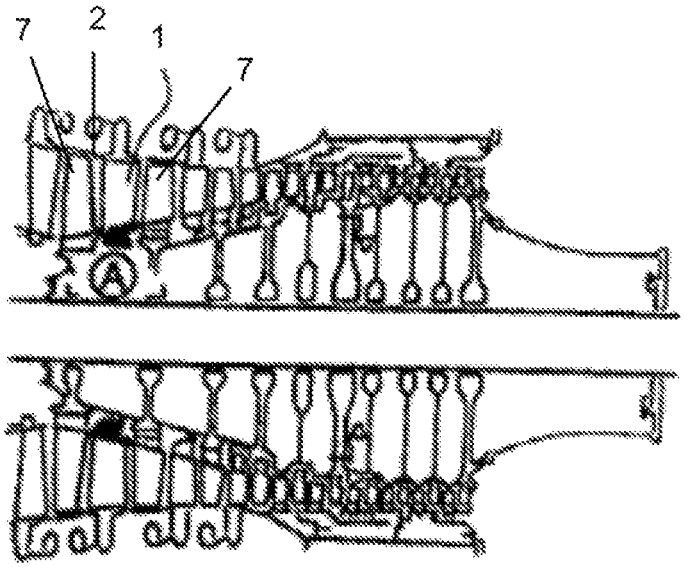

FIG. 1 shows, in the meridional plane, part of a state-of-the-art fluid flow machine in the area of one of its variable stator rows 1. Besides the variable stator row 1 proper, components in the hub area 3 and in the casing area 2 are indicated which bear the variable stator 1 on the inner and outer side. FIG. 10 shows in highly simplified form a partial area of a fluid flow machine according to the state of the art which can utilize the present invention. Variable stator row 1 and rotors 7 are shown with casing area 2.

View A-A on the right-hand side of the figure shows the inner flow path boundary (hub 3) in the plane established by the meridional direction m and the circumferential direction u. The state-of-the-art design here shown provides rotary bases 5 of the individual variable vanes which are separately borne in the hub 3. Each rotary base 5 is connected to a single vane 1. Here, the airfoil 1 clearly protrudes beyond the rotary base 5 with its leading and/or trailing edge. While the view exemplifies the hub 3, a principally equal arrangement of rotary bases 5 is found on the casing-side boundary of the flow path of the fluid flow machine.

More particularly, this invention relates to at least one variable unit of a stator vane row of a fluid flow machine or—as an element—to a variable inlet guide vane assembly, if applicable. The respective blading is situated within a casing, which confines the passage of fluid through at least one rotor blade row (rotor) and at least one stator vane row (stator) in the outward direction. While a rotor includes several rotor blades attached to a rotating shaft and transfers energy to the working medium, a stator has several stator vanes mostly fixed in the casing.

In the state of the art, it is disadvantageous that the corresponding arrangements of airfoil and rotary base incur large radial partial gaps at the vane ends leading to considerable pressure losses in the flow. The consequence of this is that the efficiency achievable and the operating characteristics of the fluid flow machine are impaired. In particular with variable stators, no arrangements of vanes and rotary bases exist which enable the vane overhang and the associated radial partial gaps to be largely or even fully avoided.

A broad aspect of the present invention is to provide a variable stator vane arrangement of the type specified at the beginning which, while avoiding the disadvantages of the state of the art, is characterized by extensive or even complete avoidance of radial partial gaps at the vane end by providing at least two stator vanes on a rotary base.

The present invention relates to variable stator vane rows of fluid flow machines, such as blowers, compressors, pumps and fans of the axial, semi-axial or radial type. The working medium (fluid) may be gaseous or liquid.

The present invention relates to stators which are rotatably borne on at least one vane end and are variable around a rotational axis 4 via a spindle. As in all figures shown herein, inflow of the respective vane row 1 is from the left to the right, as indicated by the bold arrow.

According to the present invention, provision is made for a variable stator vane row for application in a fluid flow machine which on at least one main flow path confinement, hub or casing, is provided with at least one arrangement of a rotary base and at least two stator vanes fixedly connected to the rotary base, such that at least two stator vanes, during rotary variation, rotate around the same axis and are actuated by only one rotary spindle.

Figure 2A:
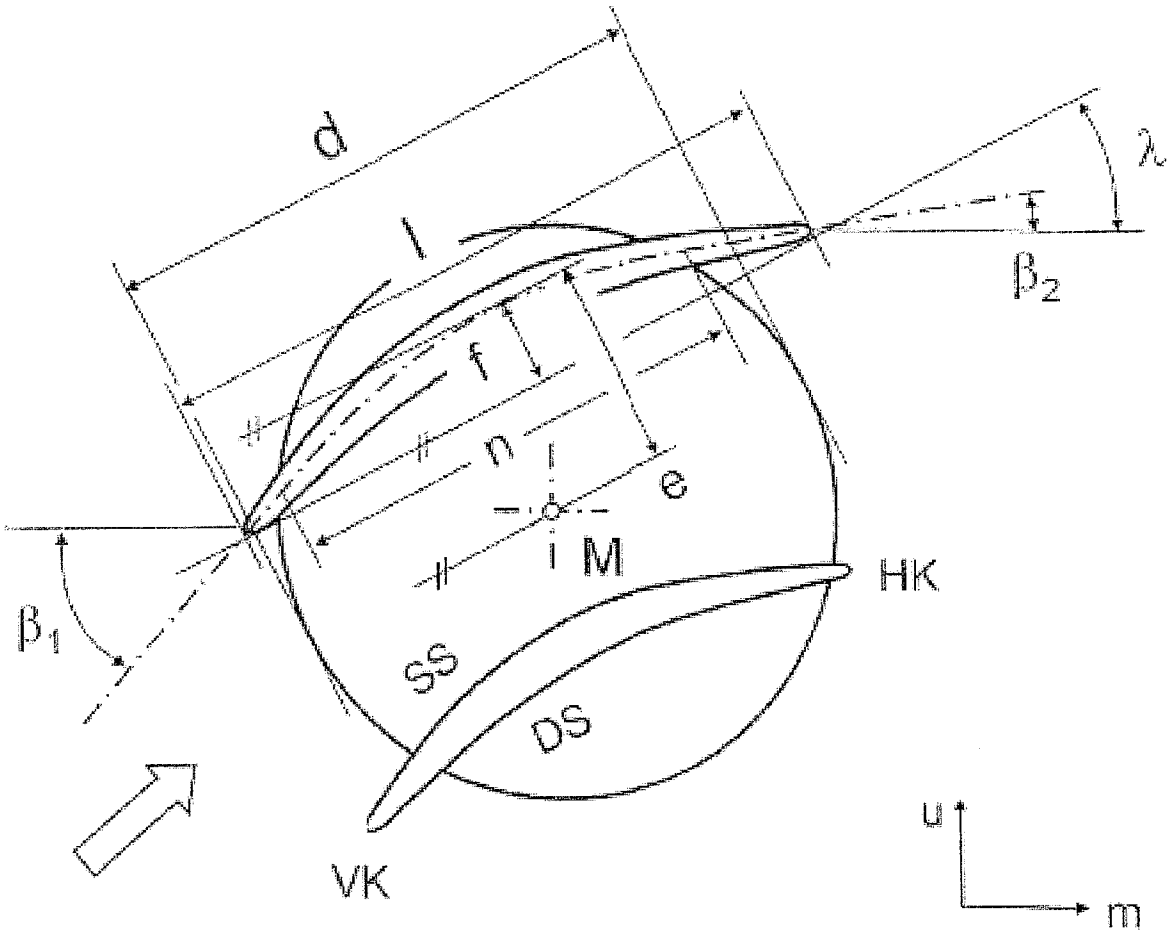
Figure 2B:
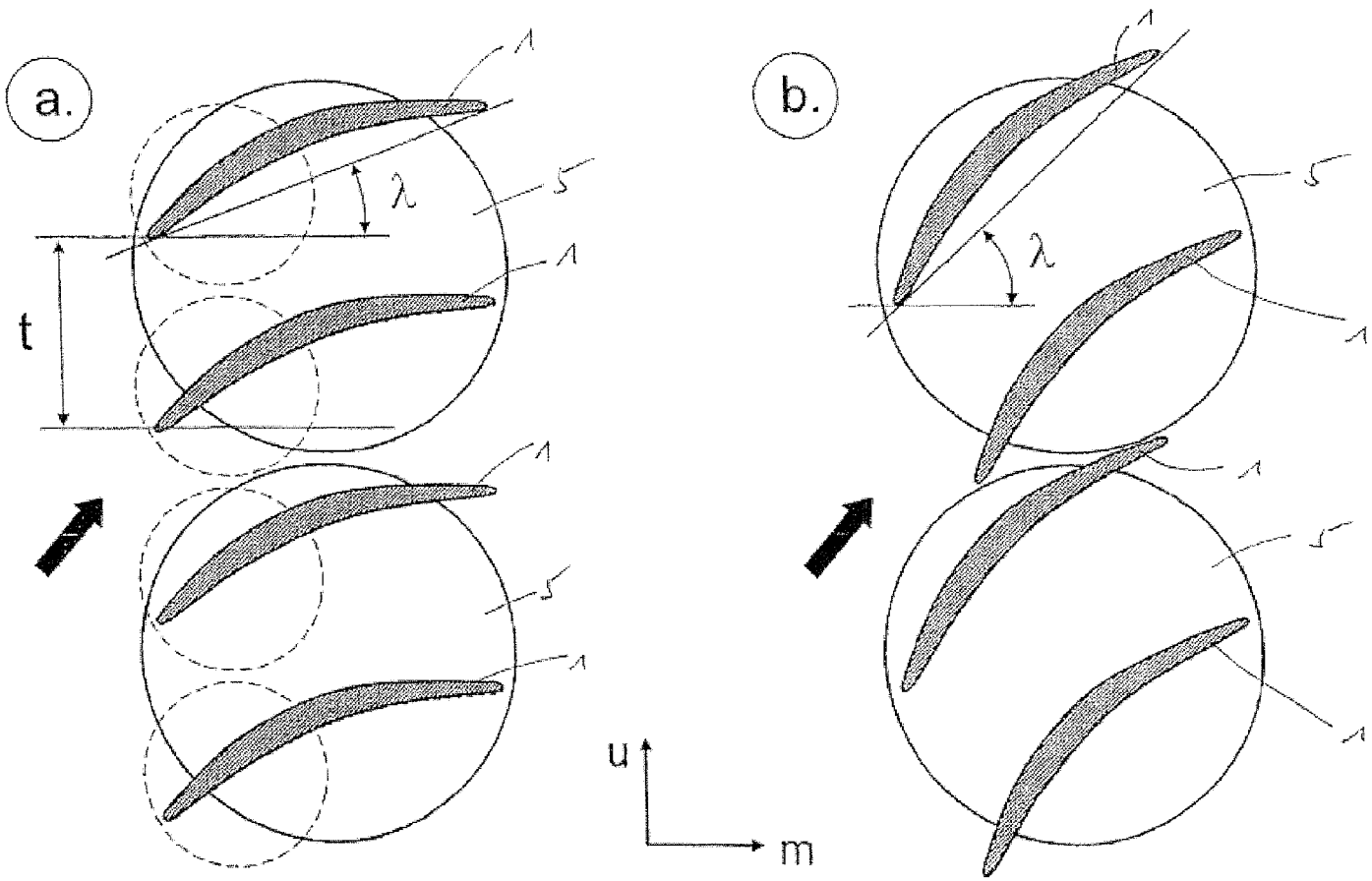
Figure 3:
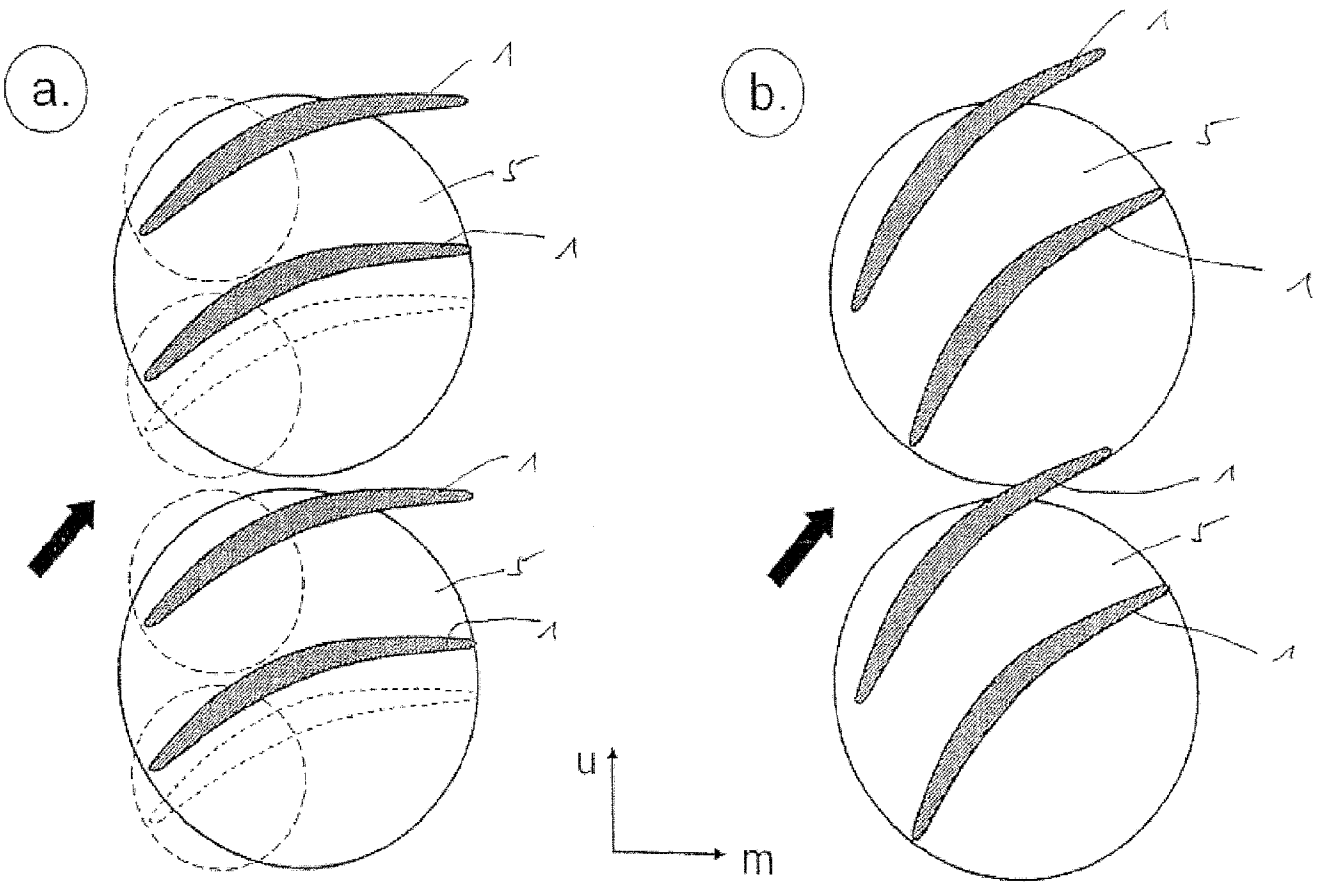
Figure 4:
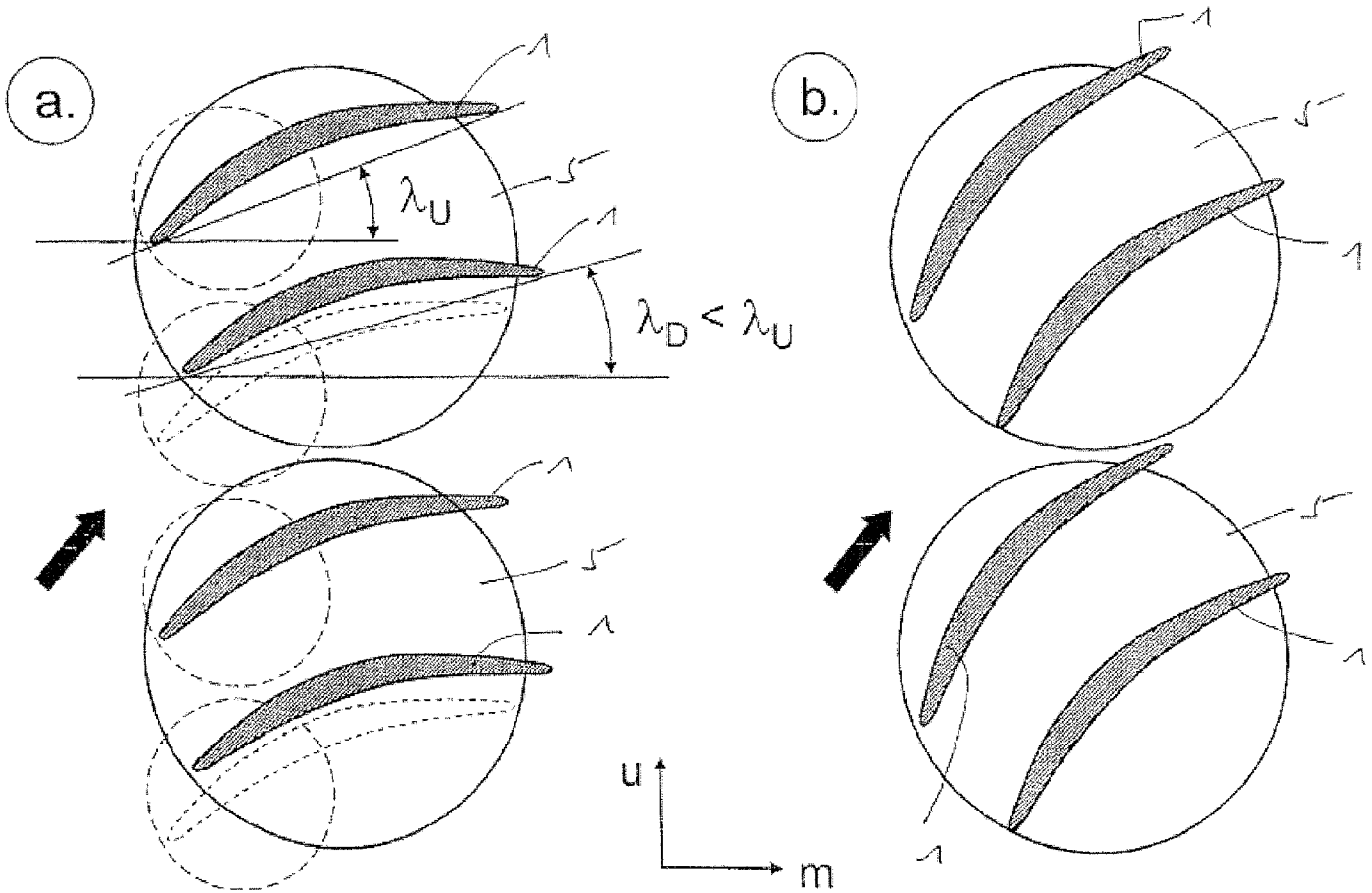
Figure 5:
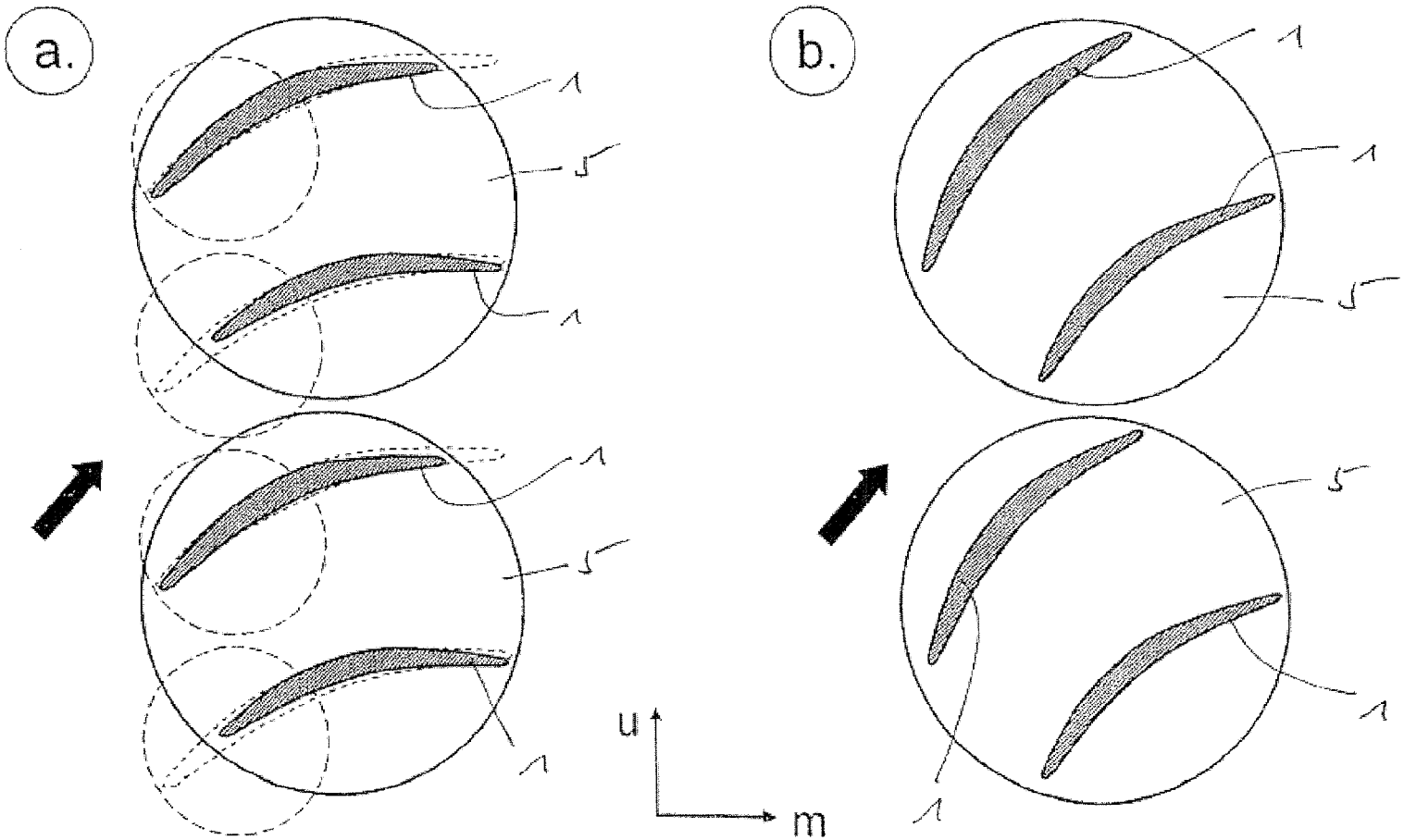
Figure 7A:
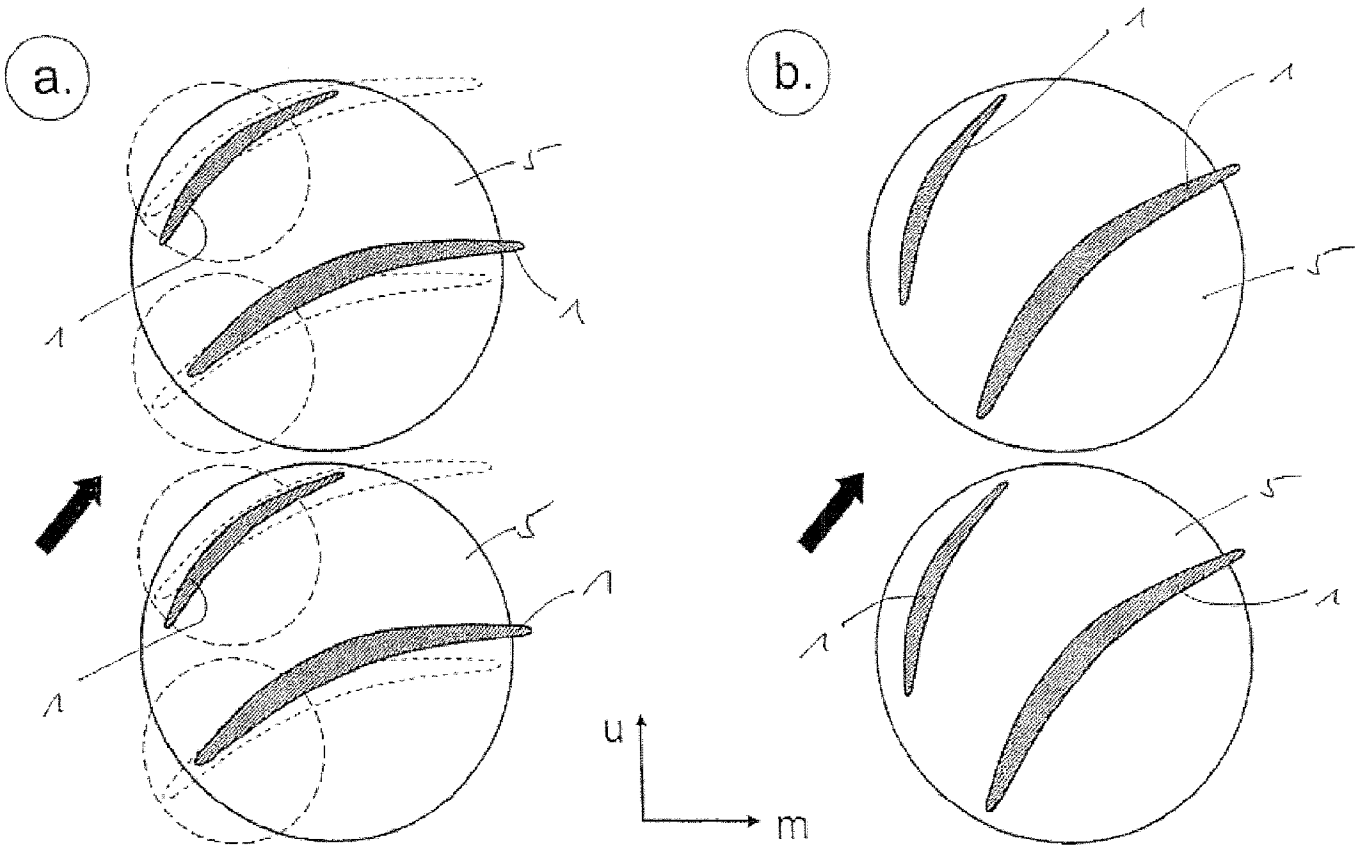
Figure 7B:
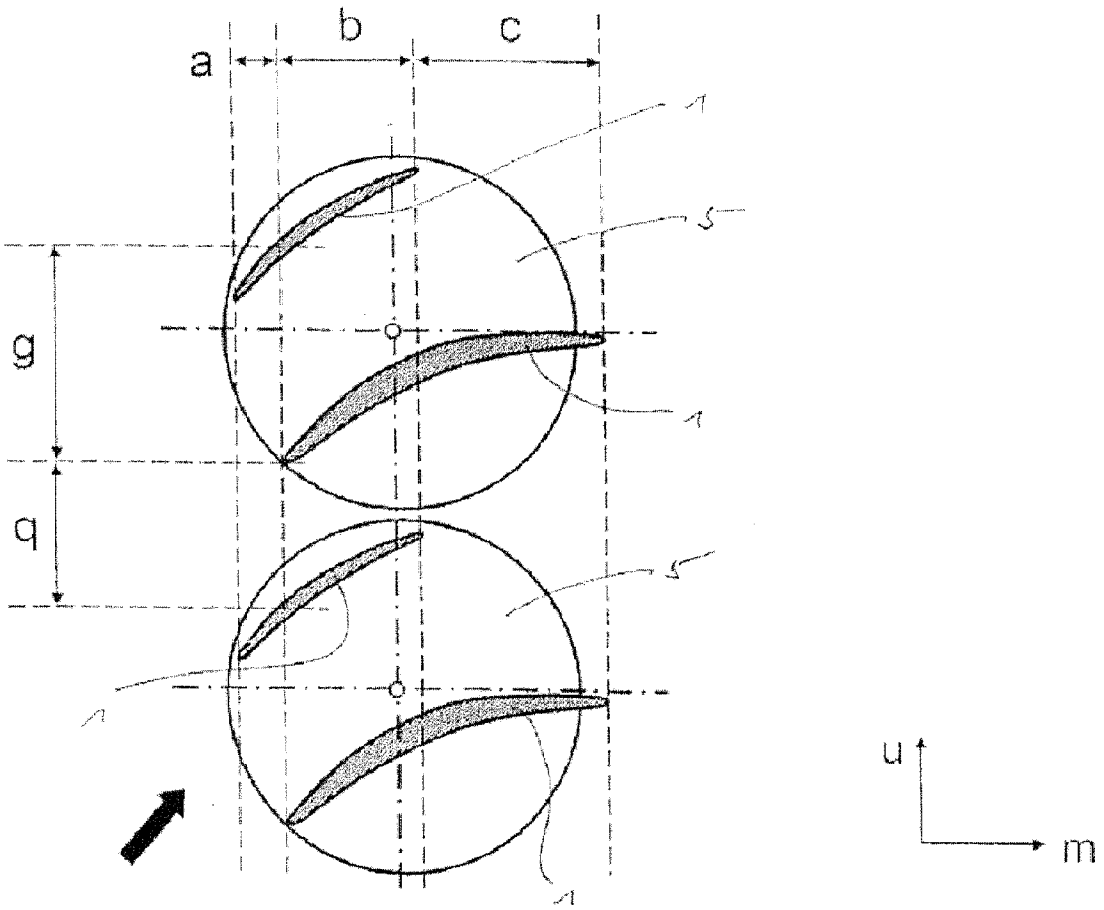
Figure 7C:
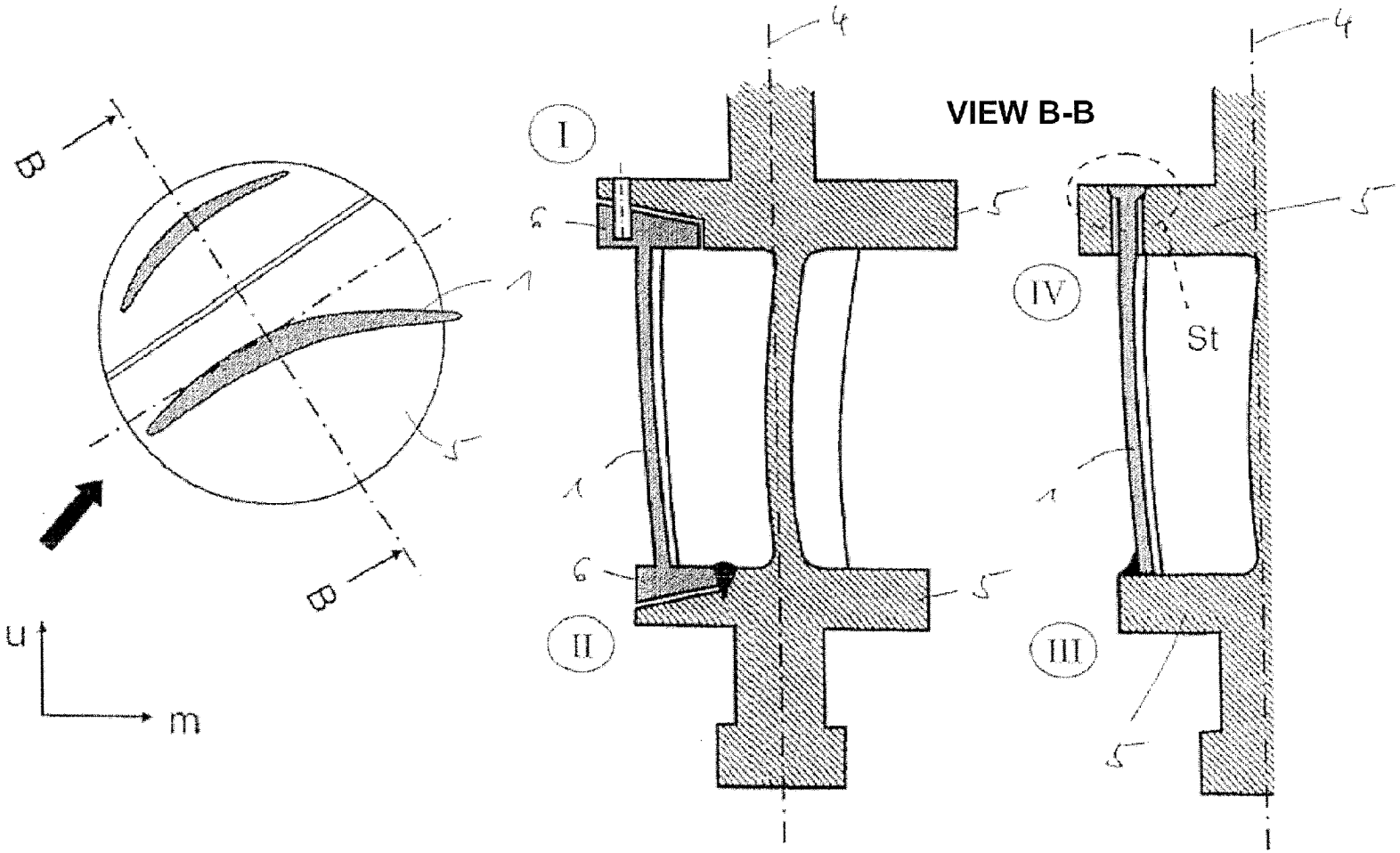
Figure 7D:
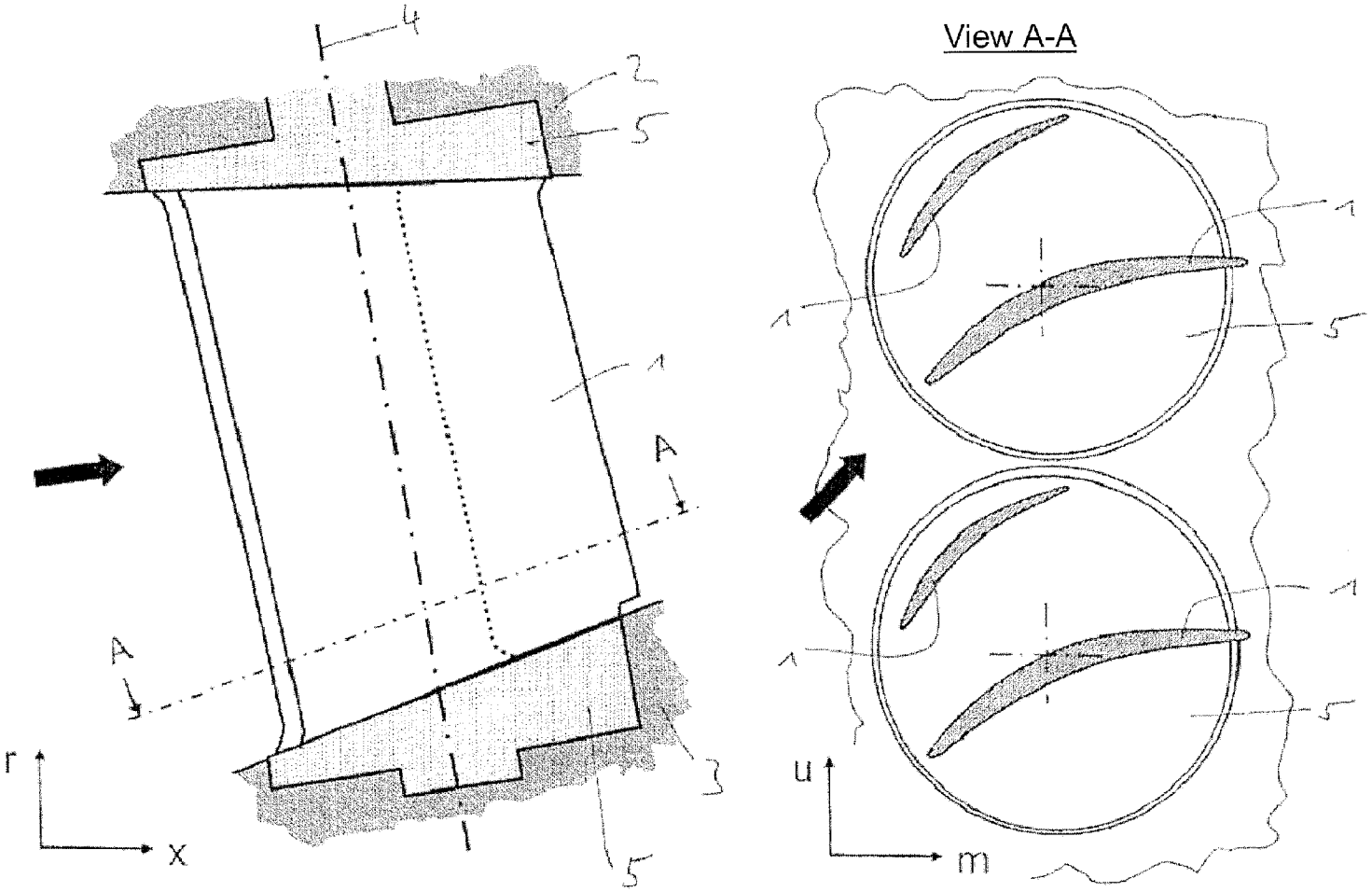
Figure 8A:
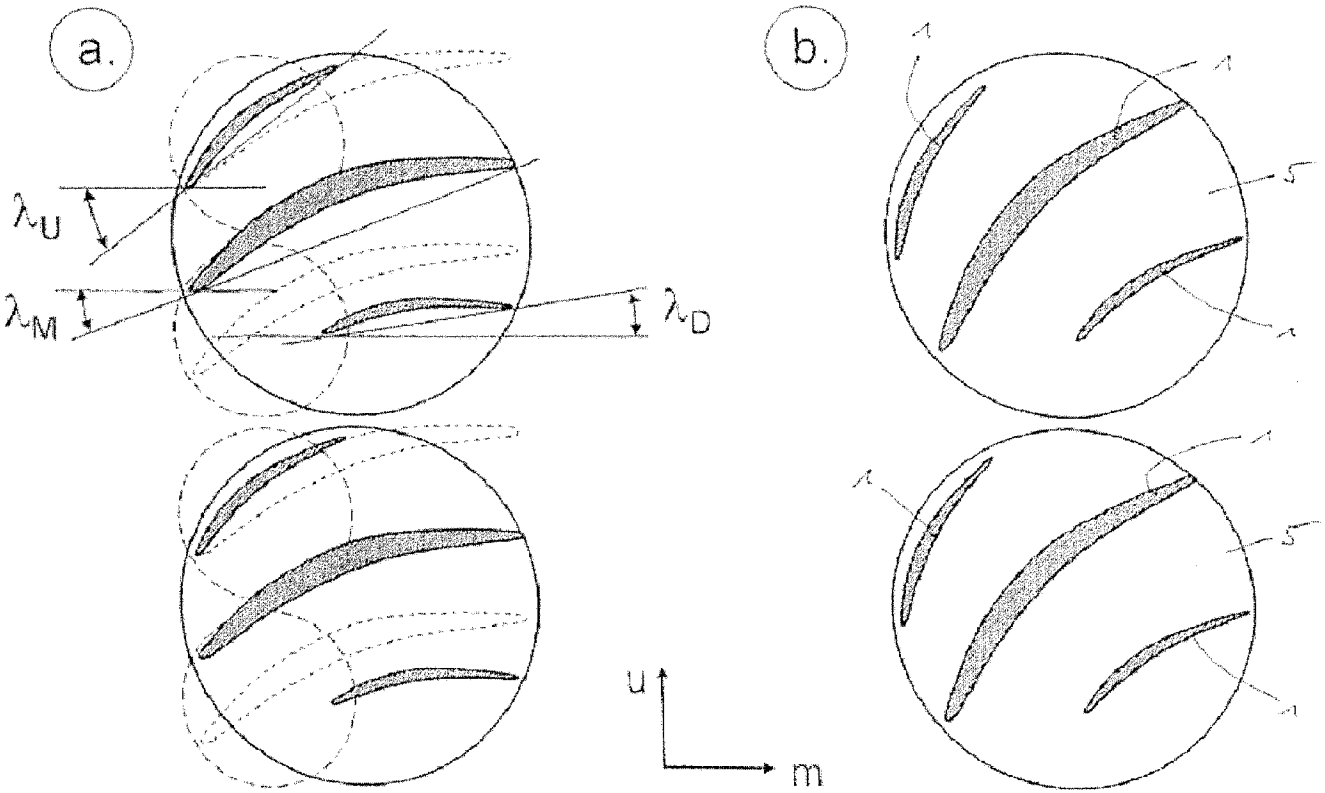
Figure 8B:
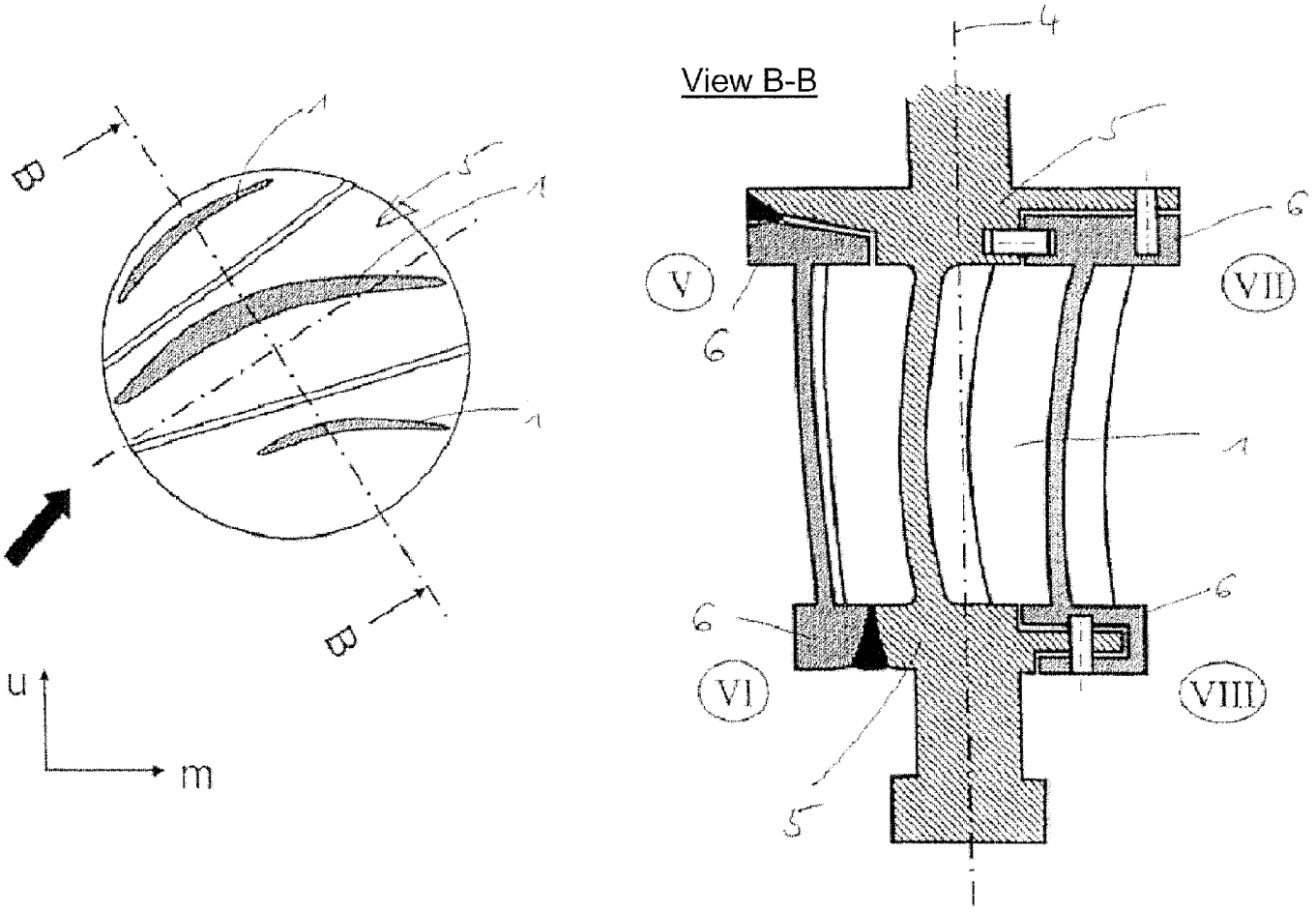
Figure 8C:
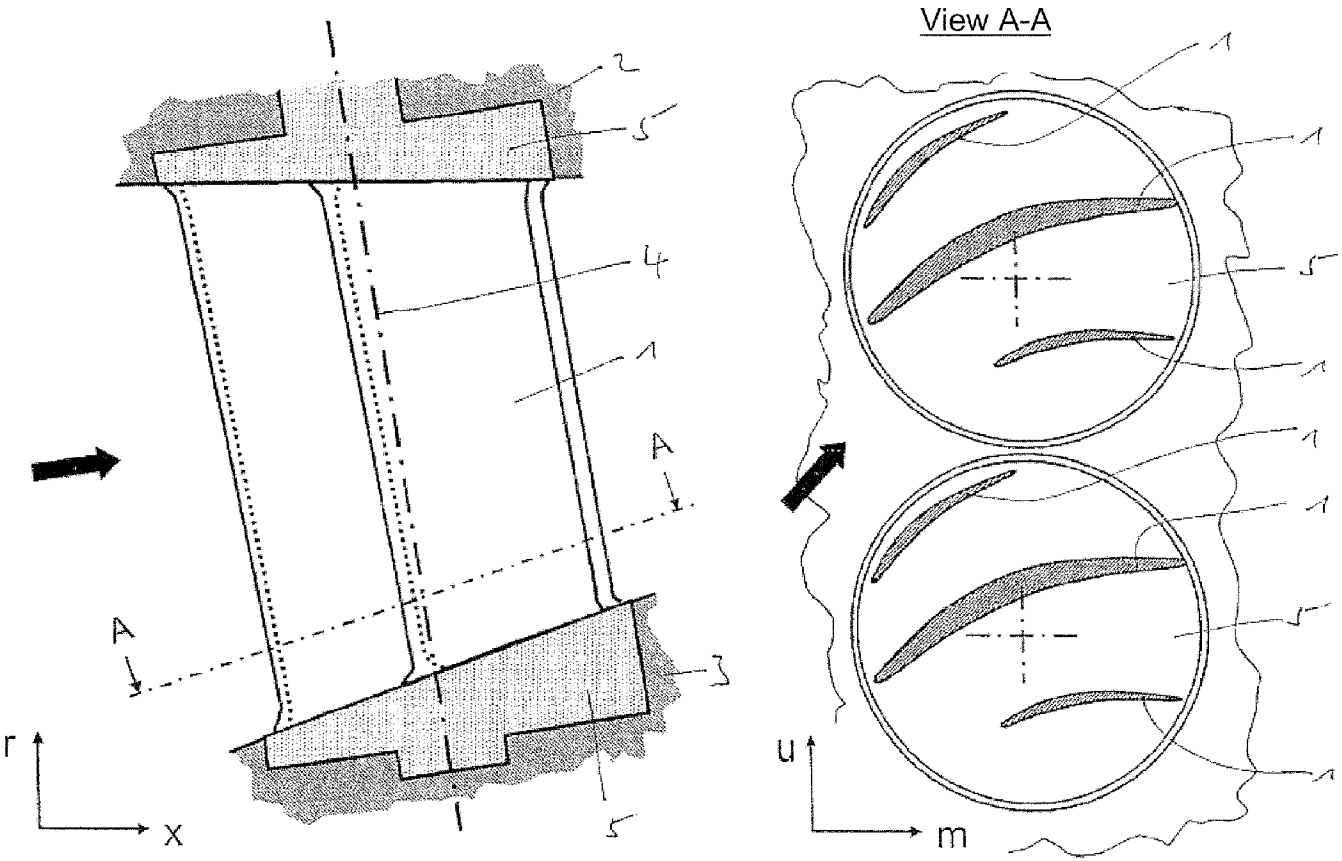
Figures 9A, 9B:
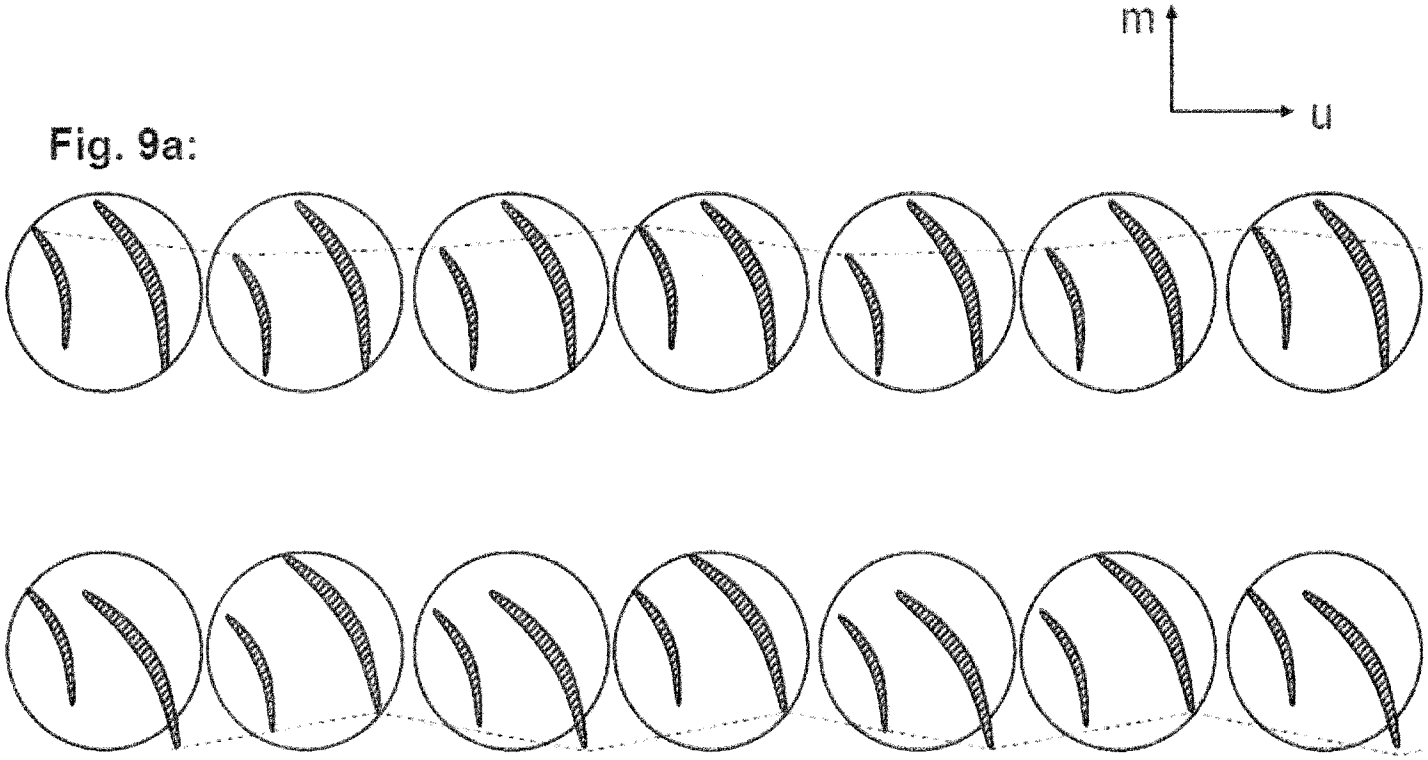

The present invention is more fully described in light of the accompanying figures showing preferred embodiments. In the drawings, FIG. 1 is a schematic representation of a variable stator in meridional view according to the state of the art, FIG. 2*a* shows a variable stator in accordance with the present invention, definition of characteristics, FIG. 2*b* shows a variable stator in accordance with the present invention, view A-A, dual configuration, evenly arranged vanes, FIG. 3 shows a variable stator in accordance with the present invention, view A-A, dual configuration, different vane pitch, FIG. 4 shows a variable stator in accordance with the present invention, view A-A, dual configuration, different vane pitch and meridional vane position, FIG. 5 shows a variable stator in accordance with the present invention, view A-A, dual configuration, different vane pitch and meridional vane position, profile shape adapted to the rotary base, FIGS. 6A-*a* and 6A-b show a variable stator in accordance with the present invention, view A-A, dual configuration, different vane pitch and meridional vane position, profile shape adapted to the rotary base, alternatingly reduced profile depth, FIG. 6B shows a variable stator in accordance with the present invention, view A-A, dual configuration in design arrangement, further characteristics, FIGS. 6C-*a* and 6C-b show a variable stator in accordance with the present invention, view A-A, dual configuration in design arrangement, close spacing of two profiles, FIGS. 6D-*a* and 6D-b show a variable stator in accordance with the present invention, view A-A, dual configuration in design arrangement, close spacing of two profiles, short front profile, FIGS. 6E-*a* and 6E-b show a variable stator in accordance with the present invention, view A-A, triple configuration, close spacing of two profiles, FIG. 7*a* shows a variable stator in accordance with the present invention, view A-A, dual configuration, different vane pitch, meridional vane position, profile shape and alternatingly reduced profile depth, FIG. 7*b* shows a variable stator in accordance with the present invention, view A-A, dual configuration in design arrangement, further characteristics, FIG. 7*c* shows a variable stator in accordance with the present invention as per FIG. 7*a*, design variant, FIG. 7*d* shows a variable stator in accordance with the present invention as per FIG. 7*a* in meridional view, FIG. 8*a* shows a variable stator in accordance with the present invention, view A-A, triple configuration, different vane pitch, meridional vane position and different profile depth, FIG. 8*b* shows a variable stator in accordance with the present invention as per FIG. 8*a*, design variant, FIG. 8*c* shows a variable stator in accordance with the present invention as per FIG. 8*a* in meridional view;

FIG. 9*a* shows leading edge points of similar stator vanes having a periodically varying meridional positioning along a circumference of the main flow path confinement;

FIG. 9*b* shows trailing edge points of similar stator vanes having a periodically varying meridional positioning along a circumference of the main flow path confinement FIG. 10 shows in highly simplified form a partial area of a fluid flow machine according to the state of the art which can utilize the present invention.

Not explicitly shown here, but also object of the present invention, are variable stator arrangements which are borne solely in either the casing or the hub, with full radial gap at the respective opposite vane end.

FIG. 2*a* shows the definition of the invention-relevant geometric characteristics in the plane established by the meridional direction m and the circumferential direction u directly on the rotary base 5. Exemplified here is a rotary base 5 with two vanes 1 attached thereon. While marked on the upper one of the two vanes 1, the characteristics also apply to each further vane 1 connected to the rotary base 5. Each vane 1 has a (usually concave) pressure side PS (DS) and a (usually convex) suction side SS. Each vane profile has a skeleton line passing centrally through the profile between the suction side and the pressure side from the leading edge LE (VK) to the trailing edge TE (HK). Another important reference line is the profile chord applied to the vane profile on the pressure side. The following characteristics are defined in FIG. 2*a:* a) Profile depth 1, measured in the direction of the profile chord;
b) Profile camber f, measured as vertical distance between the profile chord and that point of the skeleton line which is furthest off from the profile chord;
c) Leading edge inclination angle β1, measured between the meridional direction m and the tangent on the skeleton line in the leading edge point;
d) Trailing edge inclination angle β2, measured between the meridional direction m and the tangent on the skeleton line in the trailing edge point;
e) Stagger angle λ, measured between the meridional direction m and the profile chord;
f) Rotary base diameter d;
h) Profile eccentricity e, measured as vertical distance of the rotary base center M to a parallel to the profile chord through that point of the skeleton line which is furthest off from the profile chord;
i) Profile coverage n, measured between the intersections of the skeleton line with the rotary base edge circle in the direction of the profile chord (if the leading or trailing edge is located on the rotary base, the respective reference point is the leading edge or trailing edge point);
j) A meridional profile offset in meridional direction m between two adjacent profiles.

FIG. 2*b* shows in its left-hand part (a) a row of stator vanes 1 which have identical profile shape and are evenly arranged at equal pitch t in the design position, i.e. in the nominal position. The usual, conventionally designed rotary bases are illustrated by broken lines each. The solution according to the present invention provides for larger rotary bases 5, each of which is connected to two vanes 1 each in the variant here shown (dual configuration). The vanes 1 are here situated mainly on the rotary base 5 and only slightly protrude beyond the rotary base 5 with their leading and/or trailing edge, with both vanes 1 having a relative coverage n/l greater than 0.5 according to the present invention. The configuration here illustrated even shows an advantageous relative coverage n/l of more than 0.75. If the two vanes 1 have different relative coverage n/l of less than 1, a different profile shape of the two vanes 1 in the area of the rotary base 5 would also be advantageous, although it is not graphically represented herein.

The right-hand half (b) of the figure shows the variable stator arrangement according to the present invention in a part-load operating point of the fluid flow machine, i.e. at variation of the vanes 1 towards larger stagger angles λ. With larger amounts of λ, collision of two adjacent vanes 1 belonging to different rotary bases 5 will occur, so that this solution according to the present invention only qualifies for small variation ranges.

FIG. 3 shows a similar variable stator arrangement according to the present invention, as illustrated in FIG. 2*b*, however with the vane pitch between two each vanes 1 alternating such that two more closely spaced vanes 1 are arranged on one rotary base 5. In nominal position of the rotary base 5, see left-hand side (a) of the figure, the leading and trailing edges of the vanes 1 continue to form a straight line. Irrespective of the relative coverage n/l, it is here in any case advantageous to provide the profile shape of the two vanes differently. The right-hand side (b) of the figure again shows the variable stator arrangement in part-load operation. The alternating vane pitch provides for a larger range of possible variation before collision of two adjacent vanes 1 belonging to different rotor bases 5 occurs.

FIG. 4 shows a similar variable stator arrangement according to the present invention, as illustrated in FIG. 3, however with the meridional position of the vanes 1 alternating additionally such that the leading edge of one vane 1 per rotary base 5 is each arranged further downstream relative to the meridional direction m (meridional profile offset >0), the profile depths of two adjacent vanes 1 differ by less than 10 percent, and the stagger angle $\lambda_U$ of the further downstream vane is smaller than the stagger angle $\lambda_D$ of the further upstream vane, see left-hand side (a) of the figure. The right-hand side (b) of the figure again shows the variable stator arrangement in part-load operation. The different vane pitch and the meridional profile offset provide for an aerodynamically more favorable configuration and a slightly larger range of possible variation.

FIG. 5 shows a similar variable stator arrangement according to the present invention, as illustrated in FIG. 4, however with the two vanes 1 provided on a rotary base 5 significantly differing in profile depth I, stagger angle λ and meridional profile offset. The arrangement here is particularly favorably designed in that the two vanes 1 are accommodated completely, without overhang, on the rotary base 5, see left-hand side (a) of the figure. The right-hand side (b) of the figure again shows the variable stator arrangement in part-load operation. Complete accommodation on the rotary base 5 provides for an aerodynamically more favorable configuration and infinite range of variation.

FIGS. 6A-*a* and 6A-b show a similar variable stator arrangement according to the present invention, as illustrated in FIG. 5, in which the two vanes 1 are again accommodated completely, without overhang, on the rotary base 5. However, a difference of the profile depths of the two vanes 1 of at least 25 percent is here provided to better utilize the rotary base 5. On the rotary base 5, the shorter profile is here arranged on the pressure side of the longer profile, see FIG. 6A-*a*. FIG. 6A-*b* again shows the variable stator arrangement in part-load operation. Complete accommodation on the rotary base 5 provides for an aerodynamically more favorable configuration and infinite range of variation.

FIG. 6B shows the favorable dual arrangement according to the present invention with definition of further characteristics thereof. The arrangement is characterized by two vane profiles on a common rotary base, with the shorter profile being arranged on the pressure side of the longer profile. Characterizing quantities are defined in the figure:

a) Meridional profile offset a, measured in meridional direction m between the trailing edge points of two adjacent profiles;
b) Meridional overlap b, measured in meridional direction m between the leading edge point of the shorter profile and the trailing edge point of the longer profile;
c) Meridional residual distance c, measured in meridional direction m between the leading edge point of the longer profile and the leading edge point of the shorter profile;
d) Pressure-side distance q, measured in circumferential direction u between the intersection of the line passing through the trailing edge points of the longer profiles with the skeleton line of the shorter profile and the trailing edge point of the longer profile arranged on the suction side of the shorter profile;
e) Suction-side distance g, measured in circumferential direction u between the intersection of the line passing through the trailing edge points of the longer profiles with the skeleton line of the shorter profile and the trailing edge point of the longer profile arranged on the pressure side of the shorter profile.

Particularly favorable according to the present invention are the following provisions:

$$0<(a/(b+c))<0.25$$

$$0<(b/(b+c))<0.65$$

$$0.3<(q/(g+q))<0.7$$

FIGS. 6C-*a* and 6C-b show a favorable dual arrangement according to the present invention which is characterized in that the leading edge of the further downstream profile is provided in the vicinity of the trailing edge and on the pressure side of the further upstream profile, see FIG. 6C-*a*. FIG. 6C-*b* again shows the variable stator arrangement in part-load operation. The close profile spacing according to the present invention is described by further quantities identified in the figure. Here, l2 is the total profile depth, i.e. the length of the dual arrangement in the direction of the tangent applied to the total arrangement on the pressure side. The overlap b2 (positive, as shown) is measured in the direction of the total profile depth. Further characteristics are the total pitch w and the total height v, with both being measured vertically to the total profile depth. For particularly favorable arrangements according to the present invention, the following applies:

$$-0.1<(b2/T2)<0.1 \text{ and } (v/w)<0.3.$$

It is particularly favorable according to the present invention to size the relative camber f/l of the further downstream profile significantly larger than the relative camber f/l of the further upstream profile, $(f/l)_{downstream}>1.2*(f/l)_{upstream}$.

FIGS. 6D-*a* and 6D-b show a further favorable dual arrangement according the present invention with close spacing, here with short front profile, see FIG. 6D-*a*. FIG. 6D-*b* shows the variable stator arrangement in part-load operation.

FIGS. 6E-*a* and 6E-b show an arrangement according to the present invention with close spacing in which three profiles are arranged in series, see FIG. 6E-*a*. FIG. 6E-*b* shows the variable stator arrangement in part-load operation.

FIG. 7*a* shows a similar variable stator arrangement according to the present invention, in which the two vanes are accommodated on the rotary base 5 and a difference of the profile depths of the two vanes of at least 25 percent is provided to better utilize the rotary base. However, the shorter profile is here advantageously arranged on the suction side of the longer profile on the rotary base 5, see left-hand side (a) of the figure. The right-hand side (b) of the figure again shows the variable stator arrangement in part-load operation. Complete accommodation on the rotary base provides for an aerodynamically very favorable arrangement and infinite range of variation.

FIG. 7*b* shows the particularly favorable dual arrangement according to the present invention with definition of further characteristics thereof. The arrangement is characterized by two vane profiles on a common rotary base 5, with the shorter profile being arranged on the suction side of the longer profile. Characterizing quantities are defined in the figure:

a) Meridional profile offset a, measured in meridional direction m between the leading edge points of two adjacent profiles
b) Meridional overlap b, measured in meridional direction m between the leading edge point of the longer profile and the trailing edge point of the shorter profile
c) Meridional residual distance c, measured in meridional direction m between the trailing edge point of the shorter profile and the trailing edge point of the longer profile
d) Pressure-side distance q, measured in circumferential direction u between the intersection of the line passing through the leading edge points of the longer profiles with the skeleton line of the shorter profile and the leading edge point of the longer profile arranged on the pressure side of the shorter profile
e) Suction-side distance g, measured in circumferential direction u between the intersection of the line passing through the leading edge points of the longer profiles with the skeleton line of the shorter profile and the leading edge point of the longer profile arranged on the suction side of the shorter profile.

Particularly favorable according to the present invention are the following provisions:

$$0<(a/(b+c))<0.25$$

$$0<(b/(b+c))<0.65$$

$$0.3<(q/(g+q))<0.7$$

FIG. 7*c* shows the variable stator arrangement of FIG. 7*a* according to the present invention with different design solutions. In the left-hand half of the figure, the rotary base/vane arrangement is again shown in plane m-u. Marked therein is the direction and extension of View B-B.

In the right-hand half of the figure, the variable stator arrangement according to the present invention is shown in View B-B. Solutions according to the present invention refer to variable stators with at least one rotary base 5 (on the hub 3 or on the casing 2). For the purpose of representing a plurality of design solutions according to the present invention, the variable stator here shown has two ends provided with rotary bases 5, illustrating different inventive design variants. Of course, the variable stator can be produced in one piece by cutting, chemical or deposition/build-up (weld, laser, sinter) processes. However, as a particularly favorable solution, it is provided according to the present invention that the variable stator is designed and produced as an assembly of at least two components which are subsequently joined to form one variable stator unit. For this, various favorable concepts according to the present invention are described in the following:

(I) At least two vanes 1 associated to the rotary base 5 have a vane root 6 each, with the at least two vane roots 6 contributing to the roundness of the rotary base 5 at the flow path confinement.

At least one vane root 6 is here provided at the side facing the flow path in a recess in the rotary base 5. Further, a vane root 6 forms a flat, fit-in insert with, if applicable, oblique mating surface in the rotary base 5 and, if applicable, in the root of another vane 1.

The adjoining rotary base parts (resp. vane roots) are attached to each other by a single threaded or a single pinned connection. This is particularly advantageous if the concept is used on both ends of the variable stator.

(II) Same as (I), but the adjoining rotary base parts (resp. vane roots) are attached to each other by a welded connection at the main flow path confinement. This is particularly advantageous if the concept is used on both ends of the variable stator.

(III) At least one vane associated to the rotary base has no pronounced root, with the vane profile being directly connected to the rotary base being already perfectly round in the respective area.

The vane profile is attached to the rotary base by means of a welded connection immediately at the flow path confinement. This is particularly advantageous if the concept is used on both ends of the variable stator.

(IV) Same as (III), but the vane profile is fully, or by use of a tongue, fitted through a hole in the rotary base and, on the side of the rotary base facing away from the flow path confinement, clamped (by material upsetting, if applicable) as shown here (identifier St) or connected by welding (as not shown here). This is particularly advantageous if the concept is used on both ends of the variable stator.

FIG. 7*d* shows the inventive variable stator arrangement of FIG. 7*a* in meridional view. Hidden vane edges are shown in phantom.

FIG. 8*a* shows a similar variable stator arrangement according to the present invention, as illustrated in FIG. 6, in which three vanes 1 are accommodated completely, without overhang, on the rotary base 5, and a difference between the minimum and the maximum profile depths of the three vanes 1 of at least 25 percent is here provided to better utilize the rotary base 5. In accordance with the present invention it is here particularly favorable to provide a longer profile between two shorter profiles, with the short profile, which is arranged on the suction side of the long profile being disposed further upstreamly in the meridional direction m than the short profile, which is arranged on the pressure side of the long profile, see left-hand side (a) of the figure. It is further advantageous if the two short profiles have less relative camber f/l than the long profile. It is further advantageous if the long profile has small relative eccentricity of $2 \cdot e/d < 0.15$ and at least one of the short profiles has high relative eccentricity of $2 \cdot e/d > 0.35$. It is further advantageous if the stagger angle decreases from the short suction-side profile to the long central profile and further to the short pressure-side profile: $\lambda_U > \lambda_M > \lambda_D$.

The right-hand side (b) of the figure again shows the variable stator arrangement in part-load operation. Complete accommodation on the rotary base provides for an aerodynamically very favorable arrangement and infinite range of variation.

FIG. 8*b* shows the variable stator arrangement of FIG. 8*a* according to the present invention with different design solutions. In the left-hand half of the figure, the rotary base/vane arrangement is again shown in plane m-u. Marked therein is the direction and extension of View B-B.

In the right-hand half of the figure, the variable stator arrangement according to the present invention is shown in View B-B. A particularly favorable solution according to the present invention, it is again here provided that the variable stator is designed and manufactured as an assembly of at least two components which are subsequently joined to a variable stator unit. For this, different favorable concepts according to the present invention are described in the following:

(V) Same as (I), but the adjoining rotary base parts (resp. vane roots) are attached to each other by a welded connection on the side of the rotary base. This is particularly advantageous if the concept is used on both ends of the variable stator on the side of the rotary base (as not shown in the figure).

(VI) Same as (I), but at least one vane root forms the full thickness of the rotary base and abuttingly adjoins another part of the rotary base.

The adjoining rotary base parts (resp. vane roots) are attached to each other by a welded connection on the side of the rotary base facing away from the flow path confinement. This is particularly advantageous if the concept is used on both ends of the variable stator.

(VII) Same as (I), but at least one vane root is provided in a recess in the rotary base on the side facing towards the flow path. Further, the root of a vane forms a flat, fit-in insert with, if applicable, oblique mating surface in the rotary base and, if applicable, in the root of another vane.

The adjoining rotary base parts (resp. vane roots) are attached to each other by a double threaded/pinned connection. This is particularly advantageous if the concept is used on both ends of the variable stator.

(VIII) Same as (I), but at least one vane root adjoins another part of the rotary base, if applicable the root of another vane, by a tongued and grooved joint.

The adjoining rotary base parts (resp. vane roots) are attached to each other by a single threaded or single pinned connection from the side of the rotary base facing away from flow path confinement. This is particularly advantageous if the concept is used on both ends of the variable stator.

FIG. 8*c* shows the inventive variable stator arrangement of FIG. 7*a* in meridional view. Hidden vane edges are shown dotted.

The present invention can also be described as follows:

Fluid flow machine with a main flow path which is confined by a hub and a casing and in which at least one row of rotatably borne and variable stator vanes is arranged which on at least one main flow path confinement, hub or casing, is provided with at least one arrangement with at least two stator vanes connected to the same rotary base, such that the said at least two stator vanes rotate around the axis of the same drive spindle when this multi-vane variable stator unit is varied, with preferably all vane profiles arranged on the rotary base having a relative coverage n/l of more than 0.5, with preferably at least one vane profile arranged on the rotary base having a relative coverage n/l of more than 0.75, with preferably at least one vane profile arranged on the rotary base having a profile depth of 0.8<1/d<1.2 with reference to the rotary base diameter, with preferably at least one of the vane profiles arranged on the rotary base having no overhang (relative coverage n/l=1), with preferably all vane profiles arranged on the rotary base having no overhang, with preferably the distance of adjacent vane profiles of the variable stator vane row periodically varying in the circumferential direction of the fluid flow machine, with preferably in at least one position of the rotary base at least one of the connecting lines of similar vane edge points (leading edge or trailing edge points) of the vane profiles of the variable stator vane row situated on the main flow path confinement periodically variably extending along the circumference of the fluid flow machine, corresponding to a different meridional positioning of similar vane edges (see FIGS. 9*a* and 9*b* with FIG. 9*a* showing leading edge points of the shorter profile stator vanes having a periodically varying meridional positioning along a circumference of the main flow path confinement and FIG. 9*b* showing trailing edge points of both the shorter profile and longer profile stator vanes having a periodically varying meridional positioning along a circumference of the main flow path confinement), with preferably at least two of the vane profiles arranged on the rotary base having different shape in terms of at least one of the quantities profile depth 1, relative camber f/l and stagger angle λ, with preferably the stagger angle λ of the vane profiles provided on a rotary base continuously increasing from vane to vane, when viewing the multi-vane variable stator unit along the circumference of the fluid flow machine and proceeding from a convex suction side to the concave pressure side of the next profile, with two stator vanes 1 being arranged on a rotary base 5, with a difference existing in profile depth 1, and with the stator vane 1 with smaller profile depth being arranged on the rotary base 5 on the suction side of the stator vane 1 with larger profile depth, with two stator vanes 1 being arranged on a rotary base 5, with a difference existing in profile depth 1, and with the stator vane 1 with smaller profile depth being arranged on the rotary base 5 on the pressure side of the stator vane 1 with larger profile depth, with the center of the rotary base 5, relative to the stator vane 1 with larger profile depth, being provided on the same side as the stator vane with smaller profile depth, with a.) the meridional profile offset a being provided as per 0<(a/(b+c))<0.25 b.) the meridional overlap b being provided as per 0<(b/(b+c))<0.65 c.) the pressure-side distance q being provided as per 0.3<(q/(g+q))<0.7, with c being the meridional residual distance and g being the suction-side distance.

with the leading edge of at least one stator vane arranged downstream on the rotary base being provided in the vicinity of the trailing edge and on the pressure side of a further upstream stator vane, with the following applying to total profile depth l2, overlap b2, total pitch w and overall height v of the arrangement of the respective two stator vanes: −0.1<b2/l2<0.1 and v/w<0.3, with the relative camber f/l of the centroidally further downstream profile being distinctly larger than the relative camber f/l of the centroidally further upstream profile, according to $(f/l)_{downstream}>1.2*(f/l)_{upstream}$, with preferably three vane profiles being arranged on a rotary base, with the center vane profile differing from the two other vane profiles by at least 25 percent in profile depth 1, with preferably the several multi-vane variable stator units of the variable stator vane row being synchronously variable around the rotary axis (rotary base axis) throughout 360° in such a manner that collision or positional interference of adjacent multi-vane variable stator units will not occur, with preferably the multi-vane variable stator unit including at least two components which are separately manufactured and then assembled, with at least two vanes on a rotary base having a vane root each, with the at least two vane roots contributing to the roundness of the rotary base at the flow path confinement, with preferably at least one vane root having the full thickness of the rotary base and abuttingly adjoining another part of the rotary base, with attachment of the vane to the rotary base being provided by means of welding on the side of the rotary base facing away from the main flow path, with preferably at least one vane root being provided on the flow-path facing side in a recess in the rotary base, thereby forming a flat insert with, if applicable, oblique mating surface in the rotary base, and with the insert being attached by means of a threaded, pinned or welded connection, with preferably at least one vane root adjoining another part of the rotary base in the form of a tongued and grooved joint, with attachment of the vane to the rotary base being provided by means of a threaded, pinned or welded connection, preferably on the side of the rotary base facing away from the main flow path, with preferably the multi-vane variable stator unit including at least two components separately manufactured and then assembled, with at least one vane on a rotary base having no pronounced vane root and connection to the rotary base being provided by welding or jointing in the immediate vicinity of the profile of this vane, with preferably an at least partial extension of the vane profile being fitted in an opening in the rotary base and connection of the vane to the rotary base being provided on the side of the rotary base facing away from the main flow path, if applicable also by upsetting.

With the vane provided according to the present invention for application in fluid flow machines, such as blowers, compressors, pumps and fans, an improvement of flow and, in particular, boundary flow is achieved by which the efficiency of a stage with variable stator can be increased by more than 1 percent at given aerodynamic load and equal stability. With today's common aerodynamic loads, the number of vanes is reducible by up to 20 percent. The concept of the present invention is applicable to different types of fluid flow machines and, depending on the degree of utilization of the concept, yields a reduction in cost and weight of the fluid flow machine of 2 to 5 percent. In addition, there is an improvement of the total efficiency of the fluid flow machine of up to 1.5 percent depending on the respective application.

LIST OF REFERENCE NUMERALS

1 Stator vane/variable stator/variable stator row/vane/airfoil/vane row
2 Casing/casing component
3 Hub/hub component
4 Rotary spindle axis/rotary axis
5 Rotary base
6 Vane root m Meridional direction u Circumferential direction

What is claimed is:

1. A fluid flow machine, comprising:

a hub;

a casing;

at least one row of variable stator vanes;

a main flow path confined by the hub and the casing and in which the at least one row of variable stator vanes is positioned;

a multi-vane variable stator unit on at least one of the hub and the casing, having at least two stator vanes connected to a common rotary base to be rotatable around a common rotary axis;

wherein a relative camber (f/l) of a centroidally further downstream profile is larger than a relative camber (f/l) of a centroidally further upstream profile, wherein downstream and upstream are in a meridional direction, according to $(f/l)_{downstream}>1.2*(f/l)_{upstream}$, where:

(f) is a profile camber of the stator vane measured as vertical distance between a profile chord of the stator vane and a point of a skeleton line of the stator vane which is furthest off from the profile chord; and (l) is a profile depth of the stator vane measured in a direction of a profile chord of the stator vane.

2. The fluid flow machine of claim 1, wherein a stagger angle (λ) of the stator vanes provided on the rotary base continuously increases from vane to vane, when viewing along a circumference of the fluid flow machine and proceeding from a convex suction side to the concave pressure side of a next profile.

3. The fluid flow machine of claim 1, wherein all stator vanes arranged on the rotary base have a relative coverage (n)/(l) of more than 0.5, where:

(n) is a distance measured between intersections of a skeleton line of a stator vane with a rotary base edge circle in a direction of a profile chord, and if either of a leading edge and a trailing edge of the stator vane is positioned on the rotary base, (n) is measured from the intersection to the one of the leading edge and the trailing edge positioned on the rotary base; and (l) is a profile depth of the stator vane measured in a direction of a profile chord of the stator vane.

4. The fluid flow machine of claim 3, wherein at least one stator vane arranged on the rotary base has a relative coverage (n)/(l) of more than 0.75.

5. The fluid flow machine of claim 4, wherein at least one stator vane arranged on the rotary base has a profile depth of 0.8<(l)/(d)<1.2 with reference to a diameter of the rotary base.

6. The fluid flow machine of claim 5, wherein at least one of the stator vanes arranged on the rotary base has no overhang beyond the rotary base.

7. The fluid flow machine of claim 6, wherein all stator vanes arranged on the rotary base have no overhang beyond the rotary base.

8. The fluid flow machine of claim 1, wherein in at least one position of the rotary base, similar vane edge points of the stator vanes of the variable stator vane row have a periodically varying meridional positioning along a circumference of the fluid flow machine.

9. The fluid flow machine of claim 1, wherein at least two of the stator vanes arranged on the rotary base have a different shape in terms of at least one chosen from a profile depth (l), a relative camber (f/l) and a stagger angle (λ).

10. The fluid flow machine of claim 1, wherein two stator vanes are arranged on the rotary base, with a difference existing in profile depth (l), and with a stator vane with smaller profile depth being arranged on the rotary base on a suction side of a stator vane with larger profile depth.

11. The fluid flow machine of claim 1, wherein two stator vanes are arranged on the rotary base, with a difference existing in profile depth (l), and with a stator vane with smaller profile depth being arranged on the rotary base on a concave pressure side of a stator vane with larger profile depth.

12. The fluid flow machine of claim 11, wherein a center of the rotary base, relative to the stator vane with larger profile depth, is provided on a same side as the stator vane with smaller profile depth.

13. The fluid flow machine of claim 1, wherein a meridional profile offset (a) is provided as per 0<(a/(b+c))<0.25 a meridional overlap (b) is provided as per 0<(b/(b+c))<0.65 a pressure-side distance (q) is provided as per 0.3<(q/(g+q))<0.7, with (c) being a meridional residual distance and (g) being a suction-side distance;

wherein:

(a) is measured between trailing edge points of adjacent stator vanes on the rotary base when one of the stator vanes having a shorter profile length is positioned on a pressure side of the stator vane having a longer profile length;

(a) is measured between leading edge points of adjacent stator vanes on the rotary base when the stator vane having the shorter profile length is positioned on a suction side of the stator vane having the longer profile length;

(b) is a meridional overlap of the stator vanes;

(c) is a residual meridional distance beyond meridional overlap (b), measured from the edges opposite from where (a) is measured;

when the stator vane having the shorter profile length is positioned on the pressure side of the stator vane having the longer profile length, pressure side distance (q) is measured in a circumferential direction between 1) an intersection point of a circumferential line passing through the trailing edge point of the stator vane having the longer profile length with a skeleton line of the stator vane having the shorter profile length and 2) the trailing edge point of the stator vane having the longer profile length;

when the stator vane having the shorter profile length is positioned on a suction side of the stator vane having the longer profile length, pressure side distance (q) is measured in the circumferential direction between 1) an intersection point of a circumferential line passing through a leading edge of a second stator vane having a longer profile length positioned on the suction side of the stator vane having the shorter profile length with the skeleton line of the stator vane having the shorter profile length and 2) the leading edge point of the second stator vane;

when the stator vane having the shorter profile length is positioned on the pressure side of the stator vane having the longer profile length, suction side distance (g) is measured in the circumferential direction between 1) an intersection point of the circumferential line passing through the trailing edge point of the stator vane having the longer profile length with a skeleton line of a second stator vane having a shorter profile length positioned on a suction side of the stator vane having the longer profile length and 2) the trailing edge point of the stator vane having the longer profile length;

when the stator vane having the shorter profile length is positioned on the suction side of the stator vane having the longer profile length, suction side distance (g) is measured in the circumferential direction between 1) an intersection point of the circumferential line passing through the leading edge point of the stator vane having the longer profile length with the skeleton line of the stator vane having the shorter profile length and 2) the leading edge point of the stator vane having the longer profile length.

14. The fluid flow machine of claim 1, wherein a leading edge of at least one stator vane arranged downstream on the rotary base is provided in a vicinity of a trailing edge and on a pressure side of a further upstream stator vane, with a following equation applying to total profile depth (I2), overlap (b2), total pitch (w) and overall height (v) of an arrangement of the two stator vanes: $-0.1<b2/I2<0.1$ and $v/w<0.3$.

15. The fluid flow machine of claim 1, wherein, three stator vanes are arranged on the rotary base, with a center stator vane differing from two other stator vanes by at least 25 percent in profile depth (I).

16. The fluid flow machine of claim 1, and further comprising several multi-vane variable stator units synchronously variable around a rotary axis throughout 360°.

17. The fluid flow machine of claim 1, wherein the multi-vane variable stator unit includes at least two components which are separately manufactured and then assembled, with at least two stator vanes on the rotary base having a vane root each, with the at least two vane roots contributing at least partly to a roundness of the rotary base at the flow path confinement.

18. The fluid flow machine of claim 17, wherein at least one vane root has a thickness of the rotary base and abuttingly adjoins another part of the rotary base, with the stator vane being welded to the rotary base on a side of the rotary base facing away from the main flow path.

19. The fluid flow machine of claim 17, wherein at least one vane root is provided on a flow-path facing side in a recess in the rotary base, thereby forming a flat insert with an oblique mating surface in the rotary base.

20. The fluid flow machine of claim 17, wherein at least one vane root adjoining another part of the rotary base is in a form of a tongued and grooved joint, with attachment of the stator vane to the rotary base being provided on a side of the rotary base facing away from the main flow path.

21. The fluid flow machine of claim 1, wherein the multi-vane variable stator unit includes at least two components separately manufactured and then assembled, with at least one stator vane on the rotary base having no pronounced vane root and connection to the rotary base being provided by at least one of welding and jointing in an immediate vicinity of a profile of the stator vane.

22. The fluid flow machine of claim 21, wherein at least a partial extension of the stator vane is fitted in an opening in the rotary base and connection of the stator vane to the rotary base is provided on a side of the rotary base facing away from the main flow path.

23. The fluid flow machine of claim 1, wherein the multi-vane variable stator unit includes at least one stator vane having an amount of camber, a dedicated pressure side and a dedicated suction side, to turn the main flow at any position of the rotary base within a range of rotation of the rotary base.

24. The fluid flow machine of claim 1, wherein the multi-vane variable stator unit is positioned within a portion of the fluid flow machine having at least one chosen from essentially axial and semi-axial flow.

25. The fluid flow machine of claim 1, wherein at least one vane root has a thickness of the rotary base and abuttingly adjoins another part of the rotary base, with the stator vane being welded to the rotary base on a side of the rotary base facing away from the main flow path.

26. The fluid flow machine of claim 1, wherein at least one vane root is provided on a flow-path facing side in a recess in the rotary base, thereby forming a flat insert with an oblique mating surface in the rotary base.

27. A fluid flow machine, comprising:

a hub;

a casing;

at least one row of variable stator vanes;

a main flow path confined by the hub and the casing and in which the at least one row of variable stator vanes is positioned;

a multi-vane variable stator unit on at least one of the hub and the casing, having at least two stator vanes connected to a common rotary base to be rotatable around a common rotary axis;

wherein two stator vanes are arranged on the rotary base, with a difference existing in profile depth (I), and with a stator vane with smaller profile depth being arranged on the rotary base on a pressure side of a stator vane with larger profile depth;

wherein a center of the rotary base, relative to the stator vane with larger profile depth, is provided on a same side as the stator vane with smaller profile depth.

28. A fluid flow machine, comprising:

a hub;

a casing;

at least one row of variable stator vanes;

a main flow path confined by the hub and the casing and in which the at least one row of variable stator vanes is positioned;

a multi-vane variable stator unit on at least one of the hub and the casing, having at least two stator vanes connected to a common rotary base to be rotatable around a common rotary axis;

wherein a leading edge of at least one stator vane arranged downstream on the rotary base is provided in a vicinity of a trailing edge and on a pressure side of a further upstream stator vane, with a following equation applying to total profile depth (I2), overlap (b2), total pitch (w) and overall height (v) of an arrangement of the two stator vanes: $-0.1<b2/I2<0.1$ and $v/w<0.3$.

29. A fluid flow machine, comprising:

a hub;

a casing;

at least one row of variable stator vanes;

a main flow path confined by the hub and the casing and in which the at least one row of variable stator vanes is positioned;

a multi-vane variable stator unit on at least one of the hub and the casing, having at least two stator vanes connected to a common rotary base to be rotatable around a common rotary axis;

wherein the multi-vane variable stator unit includes at least two components which are separately manufactured and then assembled, with at least two stator vanes on the rotary base having a vane root each, with the at least two vane roots contributing at least partly to a roundness of the rotary base at the flow path confinement.

* * * * *